US011352178B2

(12) United States Patent
Wisniewski et al.

(10) Patent No.: US 11,352,178 B2
(45) Date of Patent: Jun. 7, 2022

(54) CLOSURE FOR A CONTAINER

(71) Applicant: AptarGroup, Inc., Crystal Lake, IL (US)

(72) Inventors: John Wisniewski, Crystal Lake, IL (US); James W. Hammond, Crystal Lake, IL (US)

(73) Assignee: AptarGroup, Inc., Crystal Lake, IL (US)

( * ) Notice: Subject to any disclaimer, the term of this patent is extended or adjusted under 35 U.S.C. 154(b) by 144 days.

(21) Appl. No.: 16/964,887

(22) PCT Filed: Jan. 26, 2018

(86) PCT No.: PCT/US2018/015437
§ 371 (c)(1),
(2) Date: Jul. 24, 2020

(87) PCT Pub. No.: WO2019/147260
PCT Pub. Date: Aug. 1, 2019

(65) Prior Publication Data
US 2021/0061526 A1 Mar. 4, 2021

(51) Int. Cl.
*B65D 47/08* (2006.01)

(52) U.S. Cl.
CPC ..... *B65D 47/0809* (2013.01); *B65D 2251/10* (2013.01)

(58) Field of Classification Search
CPC ..... B65D 47/0809; B65D 2251/1075; B65D 2251/1083; B65D 2251/1066; B65D 47/0823
USPC ..... 220/254.5; 215/235
See application file for complete search history.

(56) References Cited

U.S. PATENT DOCUMENTS 3,140,019 A 7/1964 Barr
3,845,872 A 11/1974 Towns et al.
3,957,172 A * 5/1976 Hasegawa ..... B65D 17/4012 220/267

(Continued)

OTHER PUBLICATIONS

International Search Report and Written Opinion dated Apr. 9, 2018.

*Primary Examiner* — Frederick C Nicolas
*Assistant Examiner* — Michael J. Melaragno
(74) *Attorney, Agent, or Firm* — Wood, Phillips, Katz, Clark & Mortimer

(57) ABSTRACT

A closure (40, 40A, 40B) for use with a container includes a body (54, 54A, 54B) defining a passage (72, 72A, 72B) and a first latch portion (92, 92B). The closure (40, 40A, 40B) has a lid (56, 56A, 56B) defining a deflectable press portion (96, 96A, 96B) that has a connection (100, 100A, 100B) to the closure body (54, 54A, 54B). The lid (56, 56A, 56B) has a cover portion (100, 100A, 100B) including a second latch portion (120, 120A, 120B) for engaging the first latch portion (92, 92B) to releasably hold the cover portion (100, 100A, 100B) in a latched closed position in which the cover portion (100, 100A, 100B) at least partially occludes the passage (72, 72A, 72B). The lid (56, 56A, 56B) has a biased hinge (104, 104A, 104B) connecting the cover portion (100, 100A, 100B) with the press portion (96, 96A, 96B) to accommodate movement of the cover portion (100, 100A, 100B) between the latched closed position and an unlatched open position.

5 Claims, 14 Drawing Sheets

(56) References Cited

U.S. PATENT DOCUMENTS

| | | | | | |
|---|---|---|---|---|---|
| 3,964,609 | A | * | 6/1976 | Perrella | B65D 47/0866 220/838 |
| 4,371,095 | A | * | 2/1983 | Montgomery | B65D 50/045 220/819 |
| 4,607,768 | A | | 8/1986 | Taber et al. | |
| 4,848,612 | A | | 7/1989 | Beck | |
| 4,901,892 | A | * | 2/1990 | Song | B65D 47/103 222/506 |
| 5,273,177 | A | * | 12/1993 | Campbell | B65D 47/0809 220/254.5 |
| D363,222 | S | * | 10/1995 | Lay | D9/449 |
| 5,549,214 | A | * | 8/1996 | Harris | B65D 47/0847 220/908 |
| 5,927,535 | A | | 7/1999 | Goth | |
| 2002/0125203 | A1 | | 9/2002 | Bried et al. | |
| 2008/0023477 | A1 | * | 1/2008 | Markert | B65D 47/0814 220/259.3 |
| 2012/0168329 | A1 | | 7/2012 | Berggren | |

* cited by examiner

CLOSURE FOR A CONTAINER

TECHNICAL FIELD

The present invention relates generally to a closure for a container.

BACKGROUND OF THE INVENTION AND TECHNICAL PROBLEMS POSED BY THE PRIOR ART

Closures are employed to selectively prevent or permit communication between the exterior and interior of a container (e.g., bottle, flexible pouch, machine, vessel, etc.) through an opening in the container. Depending on the closure design, such communication may be either completely prevented or permitted, or partially prevented or permitted (e.g., less than 100% occlusion of a dispensing opening in the closure). A typical closure includes at least (1) a receiving structure (e.g., a body, base, fitment, etc.) arranged at an opening to the container interior, and (2) a closing element (e.g., a lid, cover, cap, etc.) that is cooperatively received by the receiving structure.

The receiving structure of the closure can typically be either (1) a separate structure that can be attached at the container opening, and that defines a passage through the structure for communicating with the container opening and the container interior, or (2) an integral structure that is a unitary portion of the container, and which defines a passage through the structure such that the passage functions as the opening to the container. Also, the closing element may be formed together with the receiving structure as a unitary article, or the receiving structure and closing element may be separately made and then assembled together.

The closing element typically is movable relative to the receiving structure passage between (1) a closed position for completely, or at least partially, occluding the passage, and (2) an open position for completely, or at least partially, exposing the passage. Some closures may include additional elements (e.g., freshness seals, dispensing valves, tamper-evident features, child safety features, locking elements, etc.).

A closure may be provided on a rigid, flexible, or collapsible container of one or more substances (e.g., medicines, pills, food items, granules, powders, oils, lotions, creams, gels, liquids, etc.). A container may be inverted by a user to dispense, or assist in dispensing, the substance from the container through the opened closure. Alternatively, the user might use a utensil to scoop or remove the substance from the container through the opened closure. The container with the closure mounted thereon, and the contents stored therein, may be collectively characterized as a "package" which may be encountered by a consumer.

One type of closure is typically provided with a closing element in the form of a lid that is directly or indirectly connected with a closure body to accommodate movement of the lid relative to the closure body. A user of such a closure would typically encounter the lid in a closed position. The lid may be provided with a region for being engaged by a user of the closure to tilt, pivot, or rotate the lid with respect to a stationary portion of the closure (e.g., closure body), thus moving the lid from the closed position into an open position such that a substance may be dispensed or withdrawn through the opened closure.

The inventor of the present invention has noted that some closures, when installed on a container in which a substance is stored, may be susceptible to inadvertent opening during shipping or handling, which can result in premature, messy leaking of the substance stored within the container. For example, the closed lid may be accidentally bumped open, or the lid may accidentally open if the inside of the lid is subjected to a sudden impact from the substance or if the internal pressure of the container increases significantly during shipping or storage in high temperature environments. As a further example, some closure lids depend on a stress or friction fit to maintain the lid in a closed position with respect to the body, and such stress or friction fits have been found by the inventor to decay over time, which might also result in inadvertent opening during shipping or storage. The inventor has found that such premature leakage through a conventional closure may be especially pronounced in an e-commerce scenario, whereby a consumer purchases a product on-line, and that product is shipped in an individual package in a generally unconstrained manner (e.g., loosely held in a pouch or box) wherein it can be subjected to a variety of forces, orientations, and temperatures.

Furthermore, the inventor has considered that it would be beneficial to provide an improved closure that is easily actuated or operable by one hand of a user, yet is resistant to accidental opening.

Further, it has occurred to the inventor that it would be desirable to provide an improved closure that is lightweight and that has a relatively low-profile configuration of the lid in the closed position.

The inventor of the present invention has also determined that it would be desirable to provide an improved closure that can be configured for use with a container of a substance so as to have one or more of the following advantages: (i) an improved ease of manufacture and/or assembly, (ii) a reduced cost of manufacture and/or assembly, and (iii) the capability to accommodate optional tamper-resistant features or other features.

The inventor of the present invention has invented a novel structure for a closure for use with a container wherein the closure addresses one or more of the above-described problems, and which includes various advantageous features not heretofore taught or contemplated by the prior art.

BRIEF SUMMARY OF THE INVENTION

According to one form of the present invention, a closure is provided for a container of a substance to control communication between the exterior and the interior of the container. The container has an opening between the exterior and the interior. The closure has a closure body that can be located at the container opening and that defines a passage through the body for communicating with the container opening. The closure body further defines a first latch portion.

The closure includes a lid which has a press portion. The press portion has a connection to the closure body and is deflectable. The lid further has a cover portion that includes a second latch portion for releasably engaging the closure body first latch portion to releasably hold the cover portion in a latched closed position. The cover portion at least partially occludes the passage of the closure body in the latched closed position. The lid additionally has a biased hinge connecting the cover portion with the press portion to accommodate movement of the cover portion between (a) the latched closed position, and (b) an unlatched open position that is moved away from the latched closed position when the first latch portion is disengaged from the second latch portion.

The closure has an arrangement of the closure body, the press portion, the cover portion, and the biased hinge that (1) locates the cover portion to extend between the biased hinge and the body first latch portion when the cover portion is in the latched closed position, and (2) locates the press portion to extend between the biased hinge and the connection to the closure body when the cover portion is in the latched closed position, whereby deflection of the press portion moves the cover portion to disengage the second latch portion from the first latch portion and urges the cover portion away from the latched closed position.

It should be appreciated that other objects, features, and advantages of the invention will become apparent from a review of the entire specification including the appended claims and drawings.

BRIEF DESCRIPTION OF THE DRAWINGS

In the accompanying drawings forming part of the specification, in which like numerals are employed to designate like parts throughout the same.

FIG. 2 shows the cover portion of the lid moved into an unlatched intermediate open position;

FIG. 3 shows the cover portion of the lid moved into another unlatched, but more open, position compared to FIG. 2;

FIG. 5 shows the open cover portion of the lid moved into an elevated location compared to FIGS. 3 and 4;

FIG. 8 shows the cover portion of the lid in a latched closed position;

FIG. 13 shows the cover portion of the lid in the fully latched closed position corresponding to FIGS. 1, 7 and 8;

DESCRIPTION OF THE PREFERRED EMBODIMENT

Figure 1:
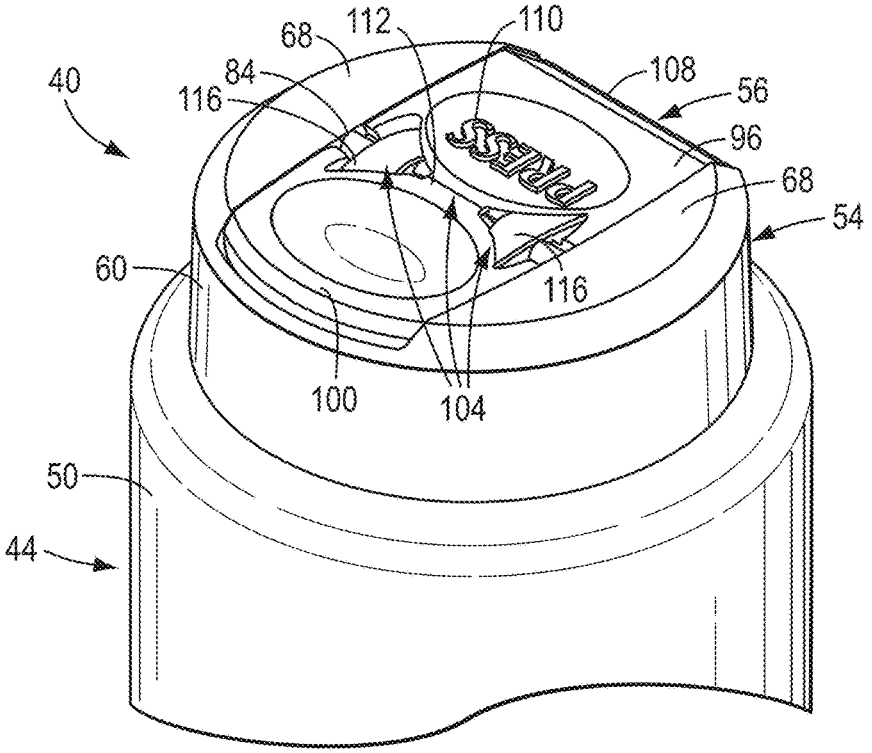
FIG. 1 is a perspective view, taken from above, of a first embodiment of a closure of the present invention shown in a latched closed position, and installed at the opening of a container wherein only a fragmentary, upper portion of the container is illustrated in FIG. 1.

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

For ease of description, many figures illustrating the invention show embodiments of a closure in the typical orientation that the closure would have when installed at the opening of a container in the form of an upright, rigid bottle. Terms such as "inward", "outward", "upper", "lower", "axial", "radial", "lateral", etc., are used with reference to this orientation. It will be understood, however, that the closures of this invention may be manufactured, stored, transported, used, and sold in an orientation other than the orientation described and illustrated.

The closures of this invention are especially suitable for use with a variety of conventional or special containers, the details of which, although not fully illustrated or described, would be apparent to those having skill in the art and an understanding of such containers. The particular containers illustrated are not intended to limit the present invention. It will also be understood by those of ordinary skill that novel and non-obvious inventive aspects are embodied in the described closures alone.

The closures described herein are especially suitable for use on a container that contains a solid material or substance in the form of a pill or tablet that can be dispensed, or otherwise removed, from the container through the opened closure. Such substances may be, for example, a food product, a pharmaceutical product, a dietary supplement, or other types of products. Such substances may be for internal use by humans or animals, or for other uses.

A first embodiment of a closure of the present invention is illustrated in FIGS. 1-19, wherein the closure is designated generally by the reference number 40. The first illustrated embodiment of the closure 40 has the form of an article that is configured to be attached or assembled to a separately manufactured container 44, which has the form of a substantially rigid bottle that would typically contain a solid substance in the form of pills or tablets.

It will be understood that the container may be any other suitable type, such as a collapsible, flexible pouch, or a generally rigid bottle that has somewhat flexible, resilient walls. FIGS. 1-16 show the first embodiment of the closure 40 attached to a container 44 that is a generally rigid bottle wherein the product within the container 44 may be removed when the closure 40 is opened and the container 44 is inverted by the user. The closure 40 may instead be used on a larger dispensing system (not illustrated) that may include, or be part of, for example, a medical device, processing machine, dispenser, reservoir on a machine, etc., wherein the system has an opening to the system interior.

The container 44, or a portion thereof, may be made from a material suitable for the intended application. For example, the container may be a bottle molded from polyethylene, polypropylene, polyethylene terephthalate, polyvinylchloride, glass, or other materials. Alternatively, the container could be a pouch made from a thin, flexible material (wherein such a material could be a polyethylene terephthalate (PET) film or a polyethylene film and/or an aluminum foil).

In applications wherein the closure 40 is mounted to a container 44 such as a bottle, it is contemplated that typically, after the closure manufacturer would make the closure 40 (e.g., by molding the closure from a thermoplastic polymer, the closure manufacturer will then ship the closure 40 to a container filler facility at another location where the container 44 is either manufactured or otherwise provided, and where the container 44 is filled with a product prior to installation of the closure 40.

Prior to installation of the closure 40 on the container 44, a removable or puncturable liner or membrane (not illustrated) could be disposed across a lower portion of the closure 40 or the top of the container 44 opening so that, after installation of the closure 40 on the container 44, the product or substance will be initially sealed from the ambient environment. If a user first encounters the package wherein a liner is sealingly attached to and across, either the closure or the container, the user would temporarily remove the closure, and then puncture or remove the liner, and then re-install the closure on the container. If the liner is sealingly attached to both the closure and container in a manner that prevents the closure from being temporarily removed, then the user could open a lid on the closure (as discussed hereinafter) and then puncture the liner.

Such a liner may be made from a foil material that includes at least one layer of metallic foil, typically aluminum, and one or more covering layers of a thermoplastic polymer or polymers that can be heat sealed to the container (and, in some applications, also to the underside of the closure) by well-known, conventional heating methods, such as induction heating, which causes the metal layer to heat up and conduct the heat into the adjacent covering layer or layers of the thermoplastic polymer.

Such a foil liner material may be of any suitable special or conventional type. One conventional liner material is a commercially available foil liner material sold under the trade designation "LAMINATE 150MDPE/0.001CPP" by Coflex Packaging having an office at 1970 John-Yule Street, Chambly, Quebec, J3L 6W3, Canada (Website: www.deluxepaper.com). This liner material consists of a layer of 25-micron thick aluminum foil that is (1) bonded with adhesive to a top layer of 25 micron thick cast polypropylene, and (2) bonded with adhesive to a bottom layer of 38 micron thick medium density polyethylene. Including the adhesive, the liner material has a total thickness of about 94 microns and has a total basis weight of about 132 grams per square meter. The particular composition of the liner material that is used for the liner forms no part of the broad aspects of the present invention.

If the above-described metal foil liner material is used with the closure 40 and the container 44, then the liner can be attached by thermal bonding (i.e., heat healing) to portions of the downwardly facing, interior surface of a bottom portion of the closure. The liner can also be attached by heat sealing to the top of the container 44. The metallic liner can be readily attached by conventional induction heat sealing of the liner's polypropylene top surface to the closure 44 that is molded from polypropylene, and by conventional induction heat sealing of the liner's bottom polyethylene surface to a polyethylene container 44.

The closure of the present invention may be advantageously used in applications with or without a liner.

If the container 44 is a collapsible pouch (not illustrated), then the closure 40 may include a suitable fitment portion that can be attached to the pouch as the pouch is being made and filled, or as the pouch is being made but before the pouch is subsequently filled through the open closure 40 or through open regions of the pouch walls that are later sealed closed.

In the first illustrated embodiment of the closure 40 in FIGS. 1-19, the closure 40 is provided as a separately manufactured article, component, or unit for being screw threaded overtop an opening in the container 44. It will be appreciated, however, that in some applications, it may be desirable for the closure 40 to be snap fit onto a container or attached to a container in a manner that would not allow a user to easily remove the closure 40. Further, it may be desirable for the closure 40 (or some part thereof) to be formed as a unitary part, or extension, of the container 44 wherein such a unitary part or extension also (i.e., simultaneously) defines an end structure of the container 44, per se.

The container 44, per se, does not form a part of the broadest aspects of the present invention. The container 44 may have any suitable configuration.

Figure 8:
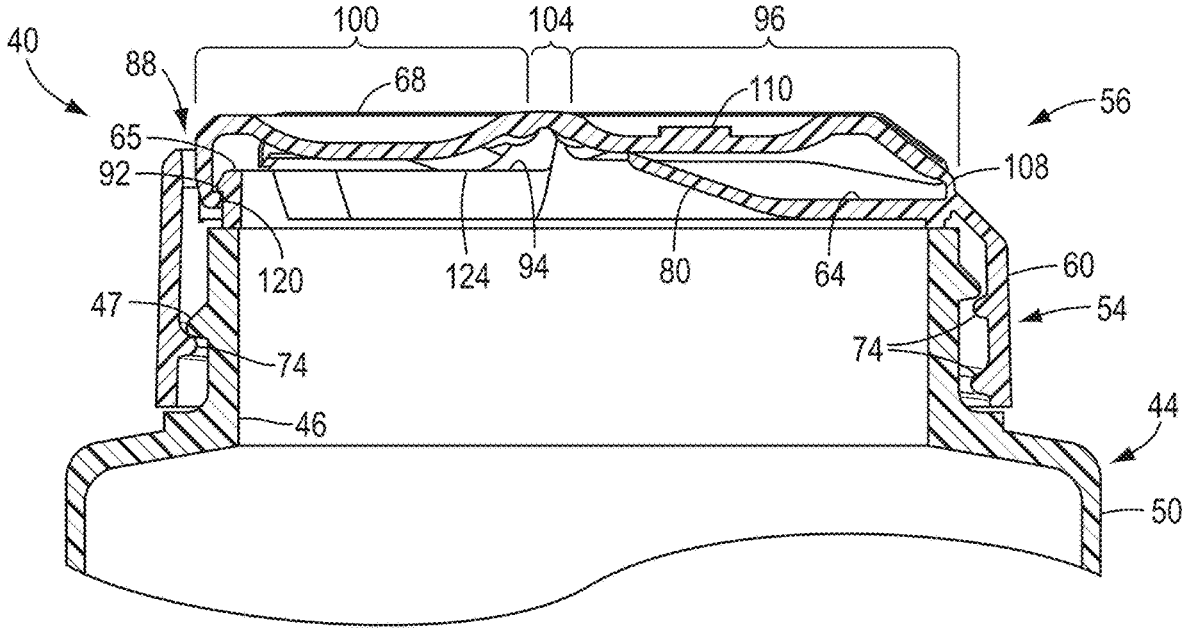
FIG. 8 is a fragmentary, cross-sectional view of the closure and container illustrated in FIG. 1, taken generally along the plane 8-8 in FIG. 7.

With reference to FIG. 8, the container 44 includes an upper end portion 46 that defines the container mouth or opening and an external thread 47 (or snap-fit bead, not illustrated) for mating with a cooperating thread 74 (or snap-fit bead, not illustrated) of the closure 40 which is discussed in detail hereinafter. The container upper end portion 46 has a cross-sectional configuration with which the closure 40 is adapted to engage. Extending downwardly from the container upper end portion 46 is a main body portion 50 of the container. The main body portion 50 of the container 44 has a cross-sectional configuration that differs from the cross-sectional configuration of the container upper end portion 46 at the container opening. In other types of containers, the container may instead have a substantially uniform shape along its entire length or height without any portion of reduced size or different cross-section.

The first embodiment of the closure 40 illustrated in the FIGS. 1-19 is especially suitable for use with a container 44 that is a bottle that may be inverted by a user, after opening the closure 40, to pour out the contents (e.g., product) from the container through the opened closure 40. In other applications, a user may keep the container generally upright and employ a finger or utensil (such as a scoop) to remove the contents (i.e., product) through the open closure. In some applications, it may be desirable to also accommodate filling or refilling of the container 44 with the product added through the opened closure 40 into the container 44.

In still other applications, the closure 40 may be used with a product containment system or other type of system (not illustrated), where the closure 40 can function to permit or prevent the egress or ingress of substances relative to the system in which the closure 40 is installed.

Figure 17:
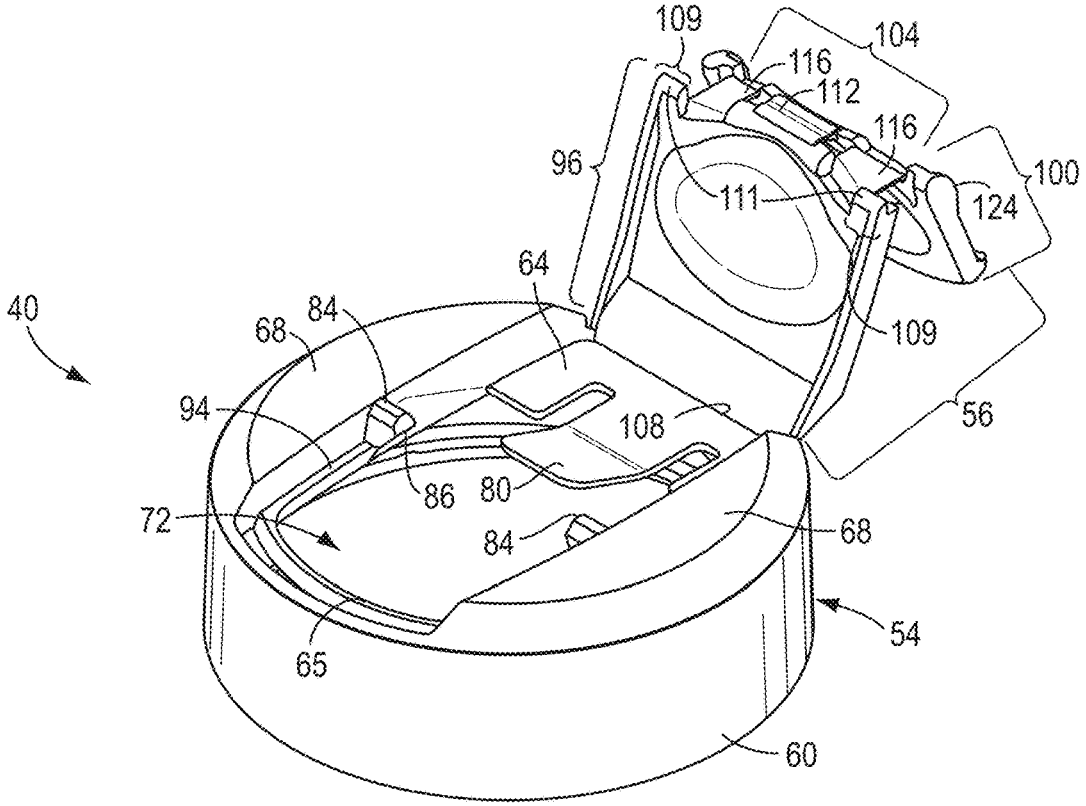
FIG. 17 is a perspective view, taken from above, of only the closure of FIG. 1 in an as-molded condition.

With reference now to FIGS. 1 and 17, the closure 40 includes the following basic components of: (i) a closure body 54; and (ii) a lid 56 that is movably mounted atop, and selectively latched with, the closure body 54. As discussed in greater detail below, a first portion of the lid 56 may be pressed downwardly (as indicated by the force arrow 57 in FIGS. 2-4 and as indicated by the representation of a finger 59 in FIGS. 10, 11, and 15) by a user to cause a second portion of the lid 56 to unlatch from the closure body 54 to permit access to the interior of the container 44 through the opened portion of the lid 56.

Referring now to FIG. 17, the closure body 54 includes a generally cylindrical skirt or outer wall 60, a recessed front deck 65, a more greatly recessed rear deck 64, and a pair of spaced-apart, raised, upper deck portions 68. The closure body 54 further includes a passage 72 for being located at the opening of the bottle 44 to communicate with an interior of the bottle 44. The lid 56 is lightweight and has a nested configuration whereby, as shown in FIGS. 1 and 8, the lid 56 resides between, and is substantially flush with, or slightly below, the upper deck portions 68 when the lid 56 is latched with the closure body 54. This compact, nested configuration of the lid 56 relative closure body 54 gives the closure 40 a desirable low height.

While the closure body 54 is illustrated as having a generally cylindrical shape, it will be appreciated, however, that the closure body 54 may take a variety of forms, and need not be limited to a cylindrical shape. For example, the closure body 54, may be ovoid, polygonal, or some irregular shape.

Figure 19:
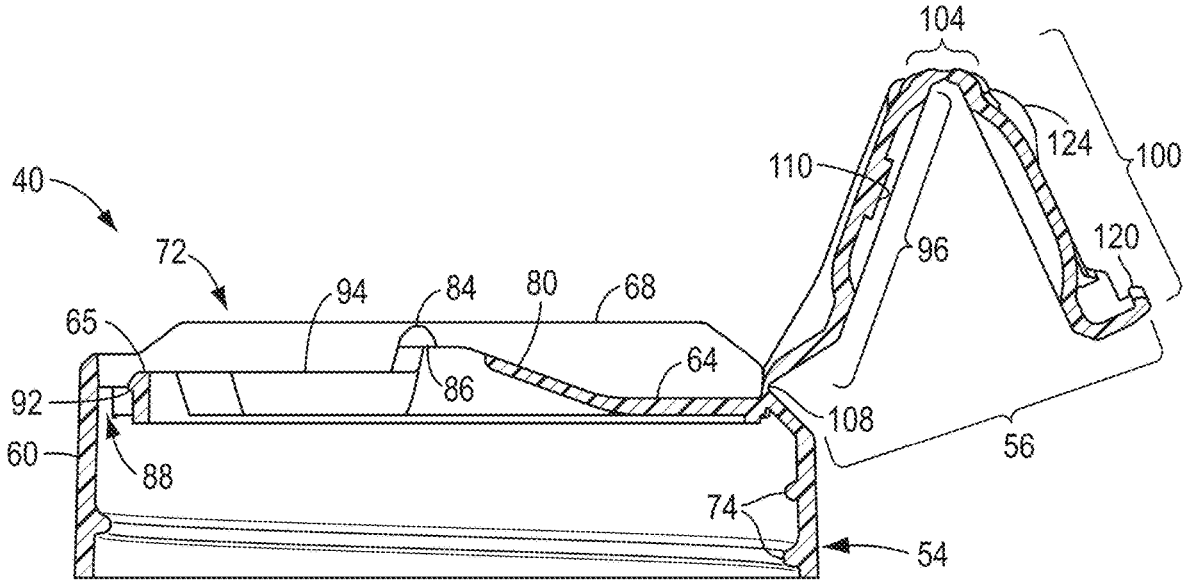
FIG. 19 is a cross-sectional view of only the closure illustrated in FIG. 17, taken generally along the plane 19-19 in FIG. 18.

Referring to FIGS. 8 and 19, the previously identified closure thread 74 is defined on the interior of the skirt 60 for cooperating and mating with the external screw thread 47 on the container 44 (FIG. 8) to securely attach the closure body 54 to the container 44 at the opening of the container 44. It will be appreciated that other conventional or special means of permanently or removably connecting the closure body 54 to the container 44 could be employed, such as mating snap-fit beads, bi-injection molding, adhesives, mechanical locks, spin welding of the closure to the container, etc.

If the closure body 54 is to be used on a flexible pouch (not illustrated), then it is presently contemplated that the closure body lower end would have a suitable boat-shaped fitment configuration (e.g., such as that shown and described in PCT/US2013/043065, which is incorporated by reference herein in its entirety) for being sealed with the pouch, and most pouch manufacturers will prefer to install the closure body lower end at an opening formed in the pouch with heat sealing techniques or ultrasonic sealing techniques.

Referring now to FIGS. 8, 17, and 19, the closure body 54 has an upwardly extending, resilient spring member or tab 80 extending from the rear deck 64. When the lid 56 is latched closed (FIG. 8), the spring member 80 abuts or engages a portion of the lid 56 to generate an upward biasing force against the lid 56, the details of which will be discussed hereinafter. As can be seen in FIG. 8, the spring member 80 projects inwardly toward the center of the closure, and further slopes upwardly in a direction away from the interior of the container 44.

Figure 14:
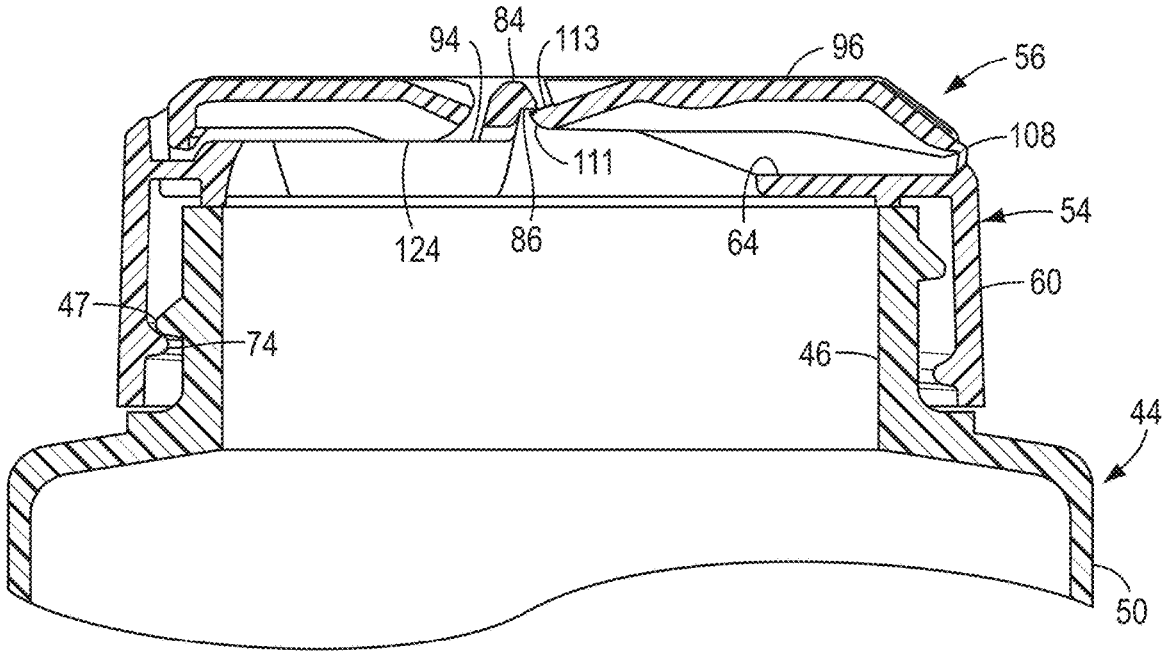
FIG. 14 is a fragmentary, cross-sectional view of the closure and container illustrated in FIG. 1, taken generally along the plane 14-14 in FIG. 7, but FIG. 14 shows the cover portion of the lid in the latched closed position corresponding to FIGS. 8 and 13.

With reference to FIGS. 14, 17, and 19, the closure body 54 includes a pair of retainer portions or retainers 84 having a downwardly-facing abutment surface 86. With the lid 56 located and configured in operative positions relative to the closure body 54 (e.g., FIGS. 13, 14, and 16), a rear portion of the lid 56 is biased against the retainers 84, the purpose of which will be described in detail below.

Figure 18:
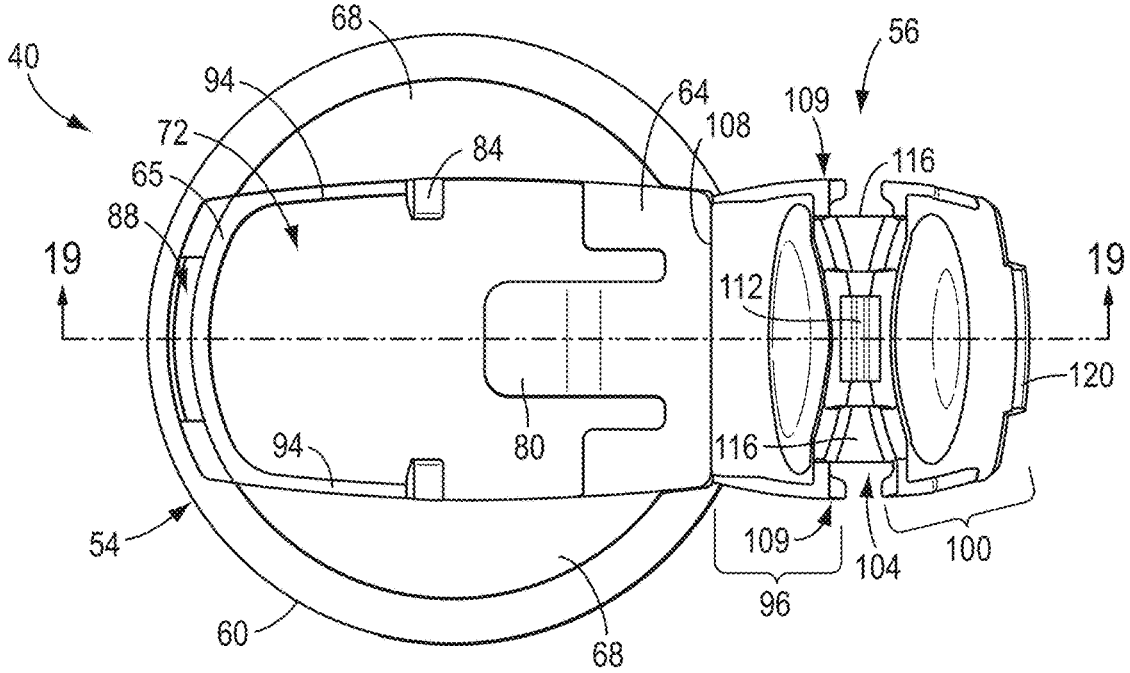
FIG. 18 is a top plan view of only the closure illustrated in FIG. 17.

Referring to FIGS. 18 and 19, a forward upper portion of the closure body 54 defines the previously identified recessed front deck 65 which, together with the outer wall 60, defines a latch hole or aperture 88. As seen in FIG. 19, the front deck 65 includes a first latch portion 92 that extends laterally into the aperture 88. The aperture 88 accommodates the reception and engagement of a mating latch feature (member or portion 120) on the lid 56 with the first latch portion 92, which will be described in greater detail hereinafter. The sides of the front deck 65 define two lateral cam follower surfaces or cam followers 94 on either side of the passage 72 for engaging a camming surface defined on the lid 56 which will be discussed hereinafter.

With reference to FIGS. 7, 8, 17 and 19, the lid 56 includes a press portion 96 and a cover portion 100 that are connected by a biased hinge 104 in the form of a bi-stable, snap-action type hinge 104 (FIGS. 1, 8, 17, 18 and 19) discussed hereinafter. When the lid 56 is latched closed (FIG. 1), the hinge 104 is initially biased to exert an opening force on the lid cover portion 100 which nevertheless remains latched closed until the latch is released as will be described hereinafter.

The closure body 54 and the lid 56 are formed as a unitary structure, preferably molded from a suitable thermoplastic material such as polypropylene or polyethylene. Other materials may be employed instead. It will be understood that in alternative designs (not illustrated), the body 54 and the lid 56 may be separately formed and then assembled in an operative combination. Further, it will be understood that the closure body 54 may be unitarily formed or molded as an extension of the upper end of the container 44 and need not be a separately formed article of manufacture.

Figure 7:
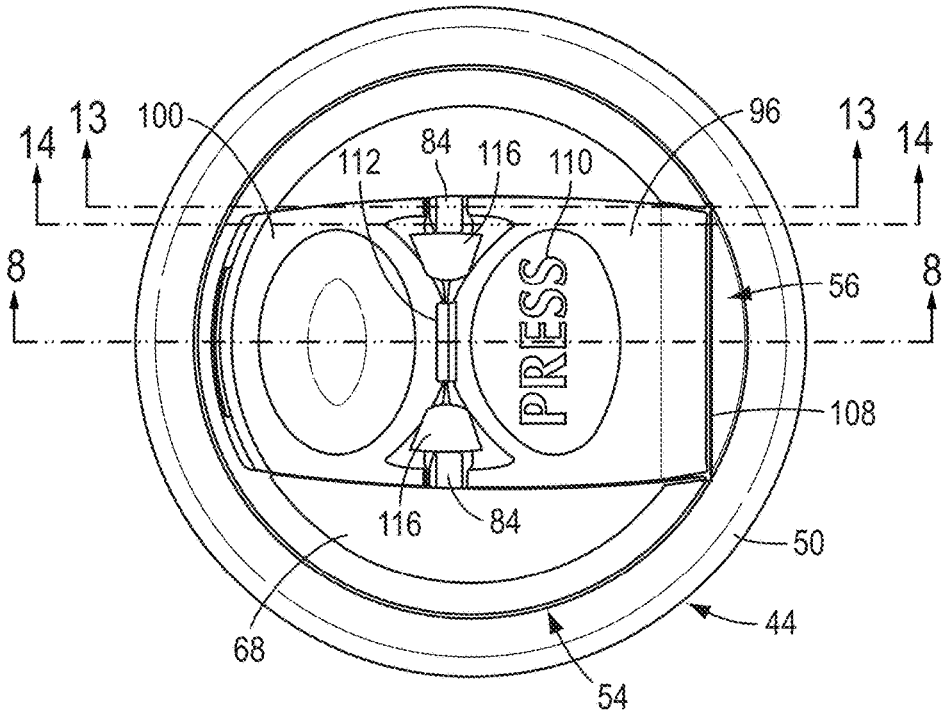
FIG. 7 is a top plan view of the closure and container illustrated in FIG. 1.

Still referring to FIGS. 7 and 19, the press portion 96 of the lid 56 of the first illustrated embodiment of the closure 40 is connected to the closure body 54 by a connection 108 that is a living hinge. The living hinge connection 108 is formed as a unitary part of, and during the molding of, the body 54, lid 56, and hinge 104. Other forms of the connection 108 might be suitably used in place of a living hinge in some applications. For example, the connection 108 between lid 56 and the closure body 54 could be replaced by an axle (on either the press portion 96 or the body 54) that is snap-fit or clamped against a bearing surface on the other one of the press portion 96 and the body 54 (such as would be the case if the lid 56 is not formed as a unitary part of the closure body 54). Furthermore, the press portion 96 could instead be snap-fit, glued, clamped, or otherwise attached with the closure body 54 such that the press portion 96 has a cantilevered configuration overtop of the closure body 54, and is deflectable relative to the closure body 54.

Figure 2:
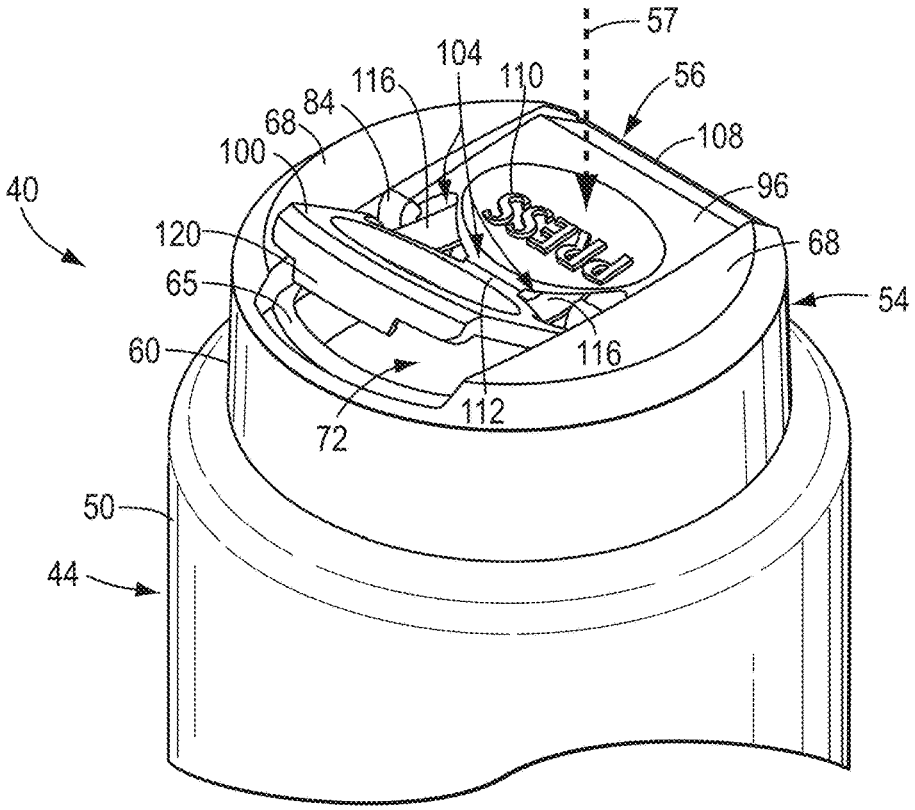
FIG. 2 is a fragmentary, perspective view, taken from above, of the closure and container illustrated in FIG. 1.

As can be seen in FIGS. 1 and 2, the press portion 96 has a concave top surface with indicia 110 formed thereon. The indicia 110 indicate to a user of the closure 40 the location against which the user should press downwardly (as indicated by the force arrow 57 in FIGS. 2-4 and as indicated by the representation of a finger 59 in FIGS. 10, 11 and 15) on the press portion 96 to actuate and open the closure 40, as will be discussed below. The press portion 96 has a pair of laterally-spaced abutment projections 109 (FIGS. 15, 17, and 18) that each have (1) a curved lower surface 111 (FIGS. 15 and 17) for sliding over top of one of the retainers 84 on the closure body 54 (when the manufacturer initially inserts the press portion between the closure body upper deck portions 68 (FIG. 17), and (2) a flat upper surface 113 (FIG. 15) for abutting the underside of the retainers 84 when the press portion 96 in an operative configuration which will be discussed in detail below.

Figure 3:
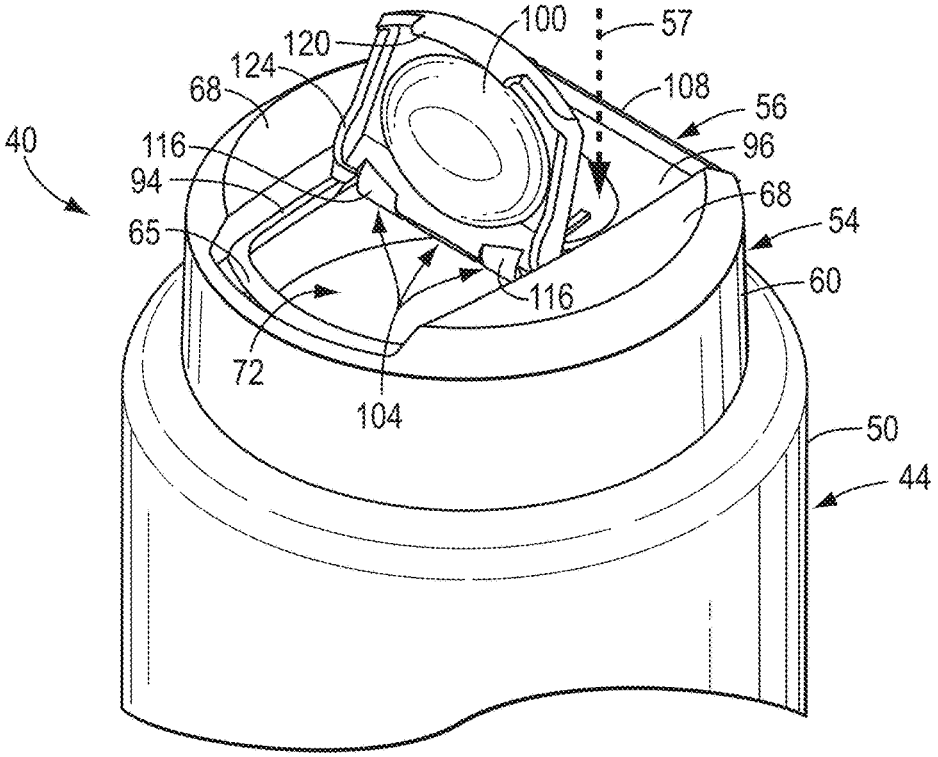
FIG. 3 is a fragmentary, perspective view, taken from above, of the closure and container illustrated in FIG. 1.
Figure 4:
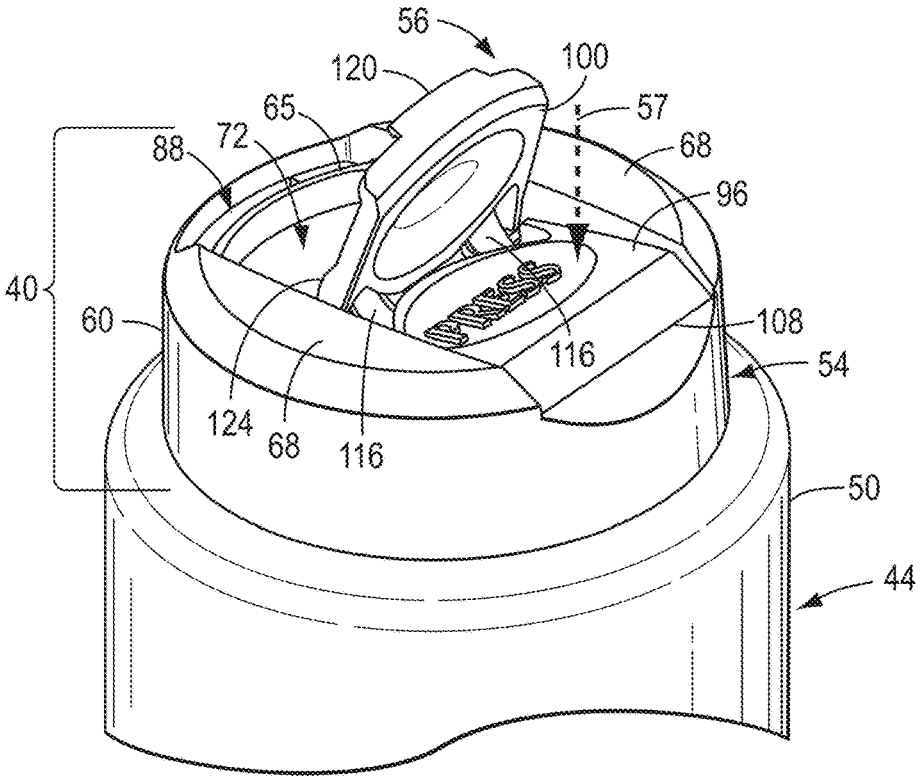
FIG. 4 is a fragmentary, perspective view, taken from above and the rear, of the closure and container illustrated in FIG. 3.
Figure 6:
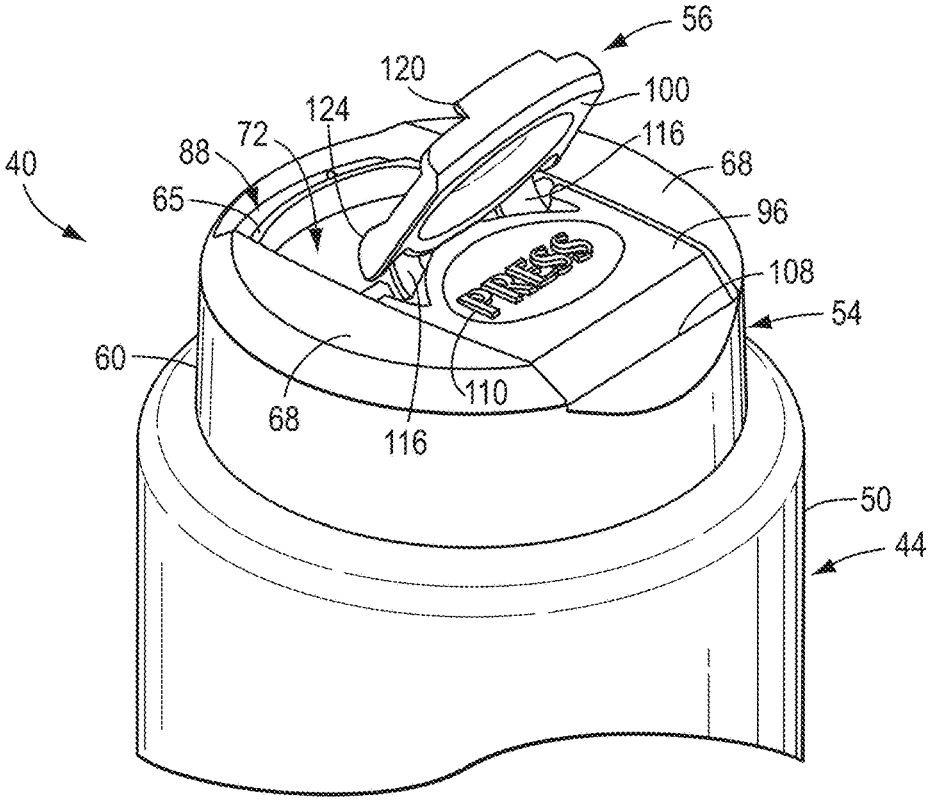
FIG. 6 is a fragmentary, perspective view, taken from above and the rear, of the closure and container illustrated in FIG. 5.

With reference now to FIG. 7, the hinge 104 is a bi-stable, snap-action type hinge employing an over-center toggle action. The biased hinge 104 includes a center pivot portion 112, and a pair of strap portions 116 located laterally, one on either side, of the center pivot portion 112. The center pivot portion 112 may include a film hinge. As viewed from the closure exterior (FIG. 1), each strap portion 116 is outwardly convex when the cover portion 100 is closed (FIG. 1), but is outwardly concave when the cover portion 100 is in a stable open position (FIGS. 3 and 6). The strap portions 116 are each initially molded in a shallow, non-planar shape with—one end connected to the press portion 96, and one end connected to the cover portion 100. The hinge 104 is molded in the configuration shown in FIGS. 17-19 wherein the strap portions 116 have substantially minimal stress. The strap portions 116 act as tension springs when their non-planar ends are spread apart during movement of the cover portion 100 as explained hereinafter. The hinge 104 has two stable configurations on either side of a dead center point to provide an over-center toggle action.

Figure 5:
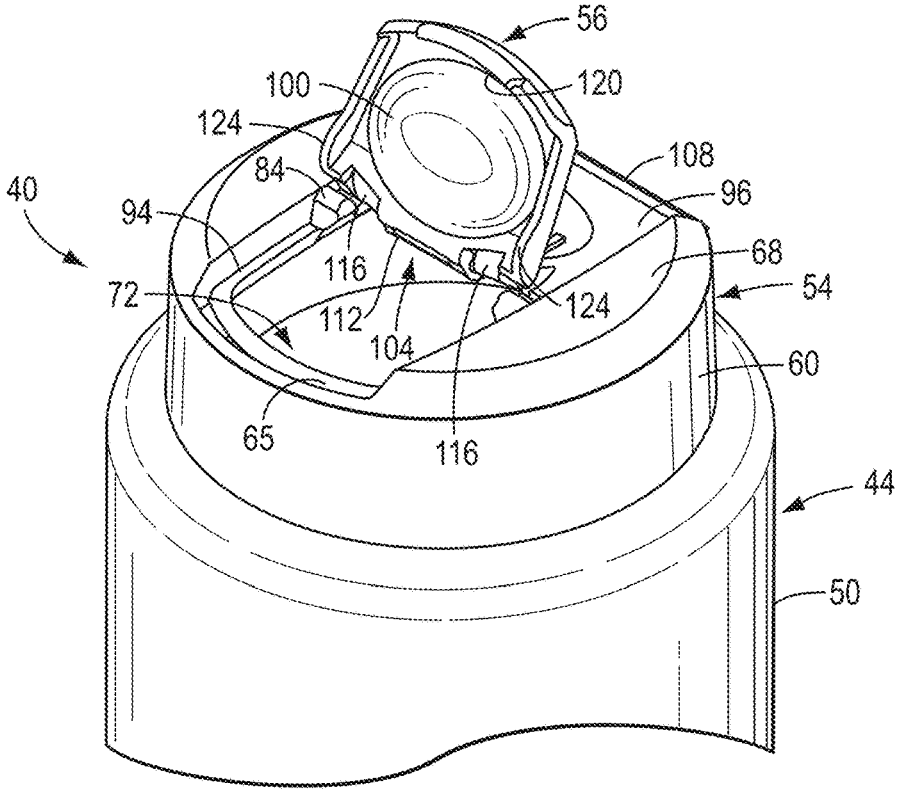
FIG. 5 is a fragmentary, perspective view, taken from above, of the closure and container illustrated in FIG. 1.
Figure 11:
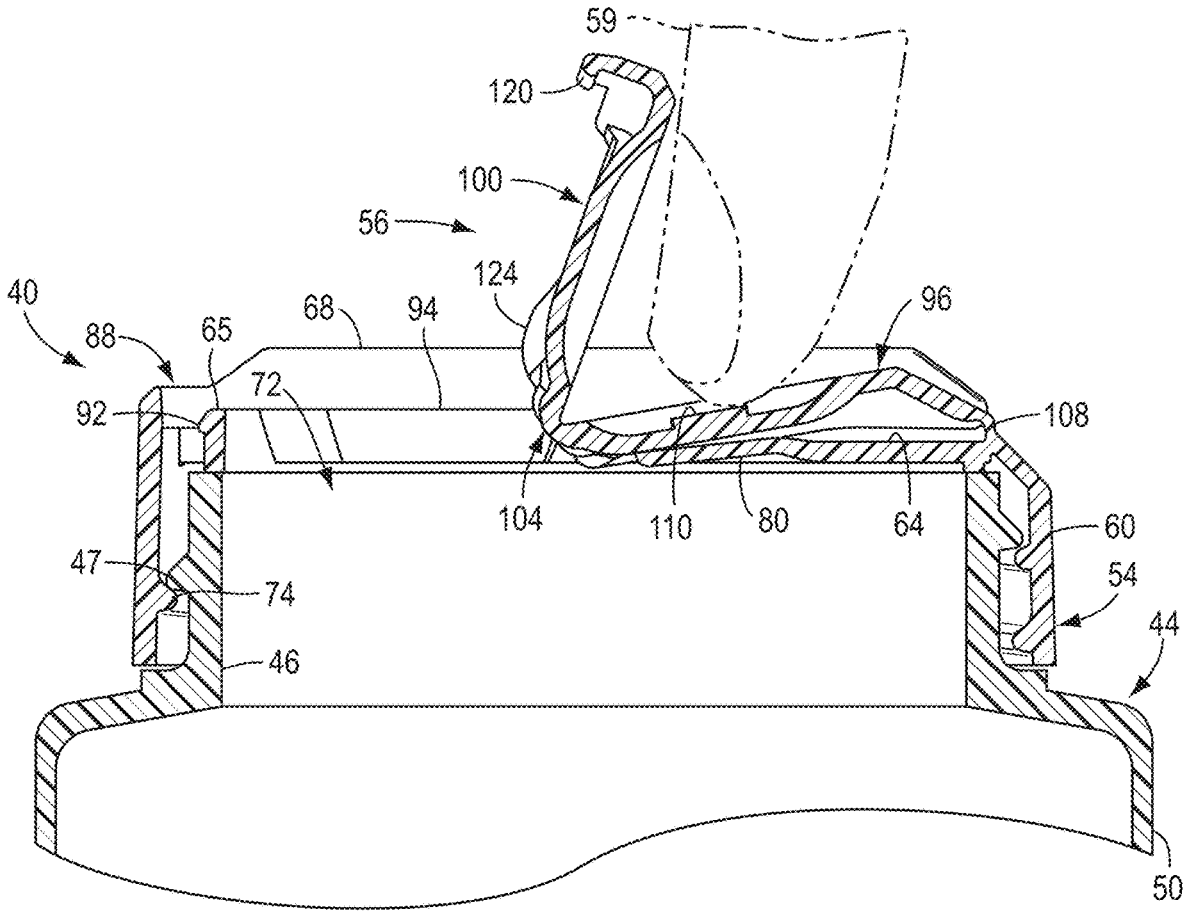
FIG. 11 is a fragmentary, cross-sectional view of the closure and container illustrated in FIG. 1, taken generally along the plane 8-8 in FIG. 7, but FIG. 11 shows the cover portion of the lid moved further to a more open position than in FIG. 10, and FIG. 11 corresponds to FIGS. 3 and 4.
Figure 12:
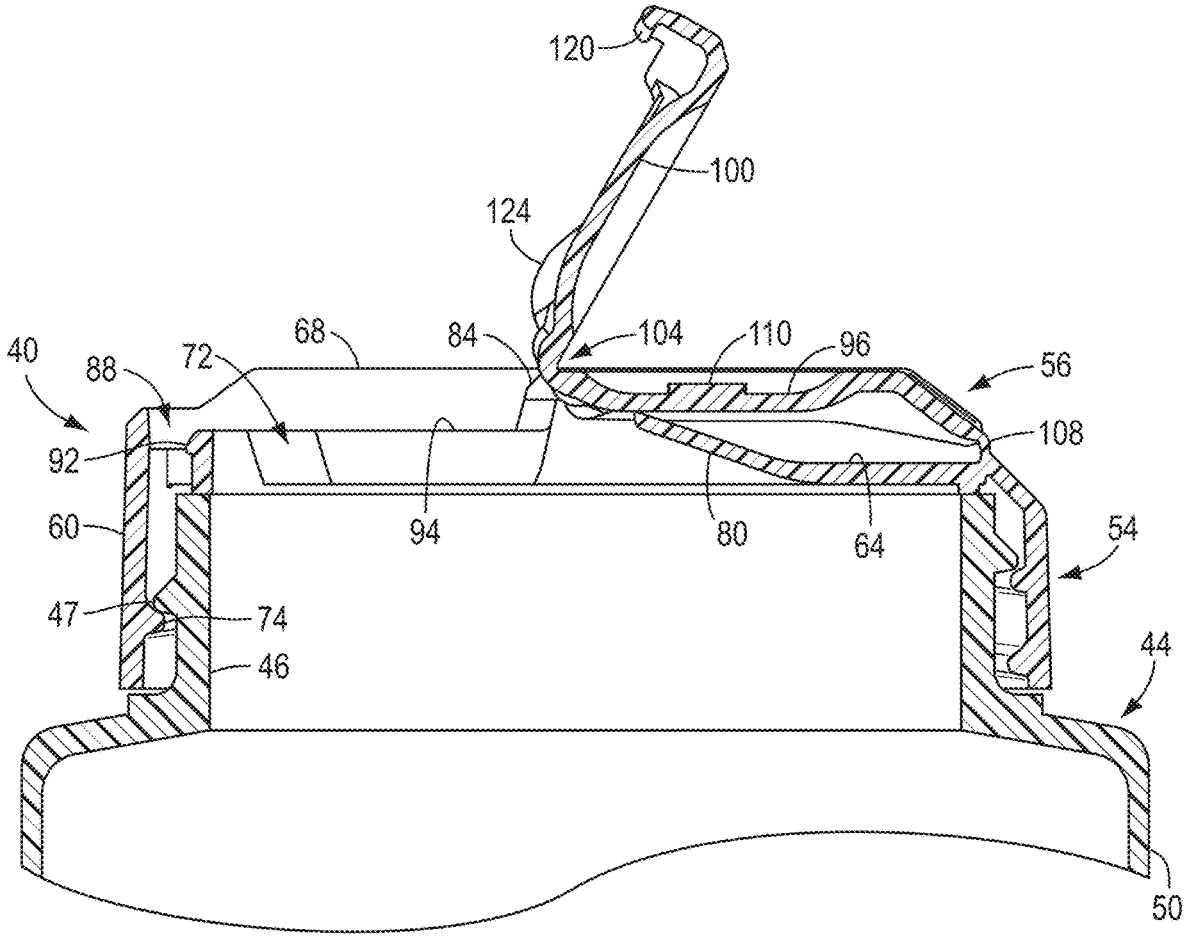
FIG. 12 is a fragmentary, cross-sectional view of the closure and container illustrated in FIG. 1, taken generally along the plane 8-8 in FIG. 7, but FIG. 12 shows the open cover portion of the lid moved to an elevated position compared to FIG. 11, and FIG. 12 corresponds to FIGS. 5 and 6.
Figure 13:
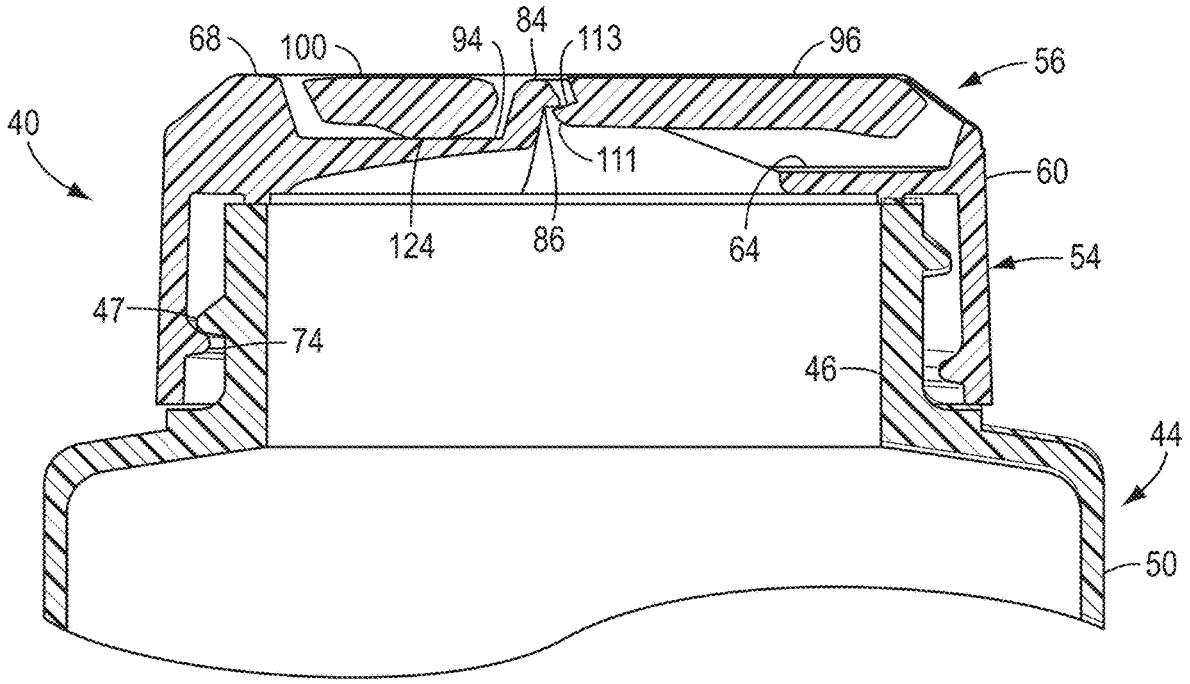
FIG. 13 is a fragmentary, cross-sectional view of the closure and container illustrated in FIG. 1, taken generally along the plane 13-13 in FIG. 7.

The structure of the hinge 104 accommodates and assists in rotating or pivoting the cover portion 100 relative to the press portion 96. Generally, as the lid cover portion 100 is moved from a first stable position to a second stable position, and vice versa, an increase in the distance between the end of the strap portion 116 attached to the cover portion 100 and the opposite end of the strap portion 116 connected to the press portion 96 creates a significant tension force or "stretch" in each strap portion 116 which is greatest at the dead center point. This causes the structure of the hinge 104 to be unstable in any configuration between a first stable configuration shown in FIGS. 1, 7, and 8 and a second stable configuration shown in FIGS. 3, 4, 11 (or as shown in FIGS. 5, 6, and 12 for the elevated location of the hinge 104). The hinge 104 is also unstable at configurations beyond the range that is defined between the two stable configurations. This results in the hinge 104 having an inherent bias (when the cover portion 100 is not in either of the two stable configurations). This bias urges the cover portion 100 to move to the closest one of the two stable positions. More specifically, the stretch or tension in the hinge strap portions 116 serves to create a temporary deformation within the structure of the hinge 104 that is sufficient to move the cover portion 100 automatically toward the closer one of the two stable positions from any other position unless the cover portion 100 is restrained (as by the closed position latch structures 92 and 120 discussed above). On either side of the dead center position, the maximum stress and deformation of the hinge 104 is at least partly reduced, and the cover portion 100 is urged to a stable position at the end of its travel range on that side of the dead center position where the strap portions 116 have minimal deformation and stress. Thus, the cover portion 100 has a first self-maintained, stable position relative to the press portion 96 as shown in FIGS. 1, 7, and 8, and the cover portion 100 has a second self-maintained, stable position relative to the press portion 96 as shown in FIGS. 3, 6, 11 and 12. A similar snap-action hinge is disclosed in PCT publication no. WO2015/069257, which is incorporated herein in its entirety. Various other snap-action hinge designs, among others, that could be used, are disclosed in PCT publication No. WO2014/189513 and are disclosed in the following patents: U.S. Pat. Nos. 4,403,712; 6,321,923; and 7,731,042.

Referring now to FIGS. 2, 8, 10, 18, and 19, the cover portion 100 includes an arcuate second latch member or latch portion 120 that is located at the distal end of the cover portion 100, relative to the hinge 104. The second latch member or latch portion 120 of the cover portion 100 fits within the aperture 88 at the front of the closure body 54 to cooperatively engage with the closure body first latch portion 92 to latch the cover portion 100 closed (and in that configuration the entire lid 56 may be described as being latched closed).

Figure 15:
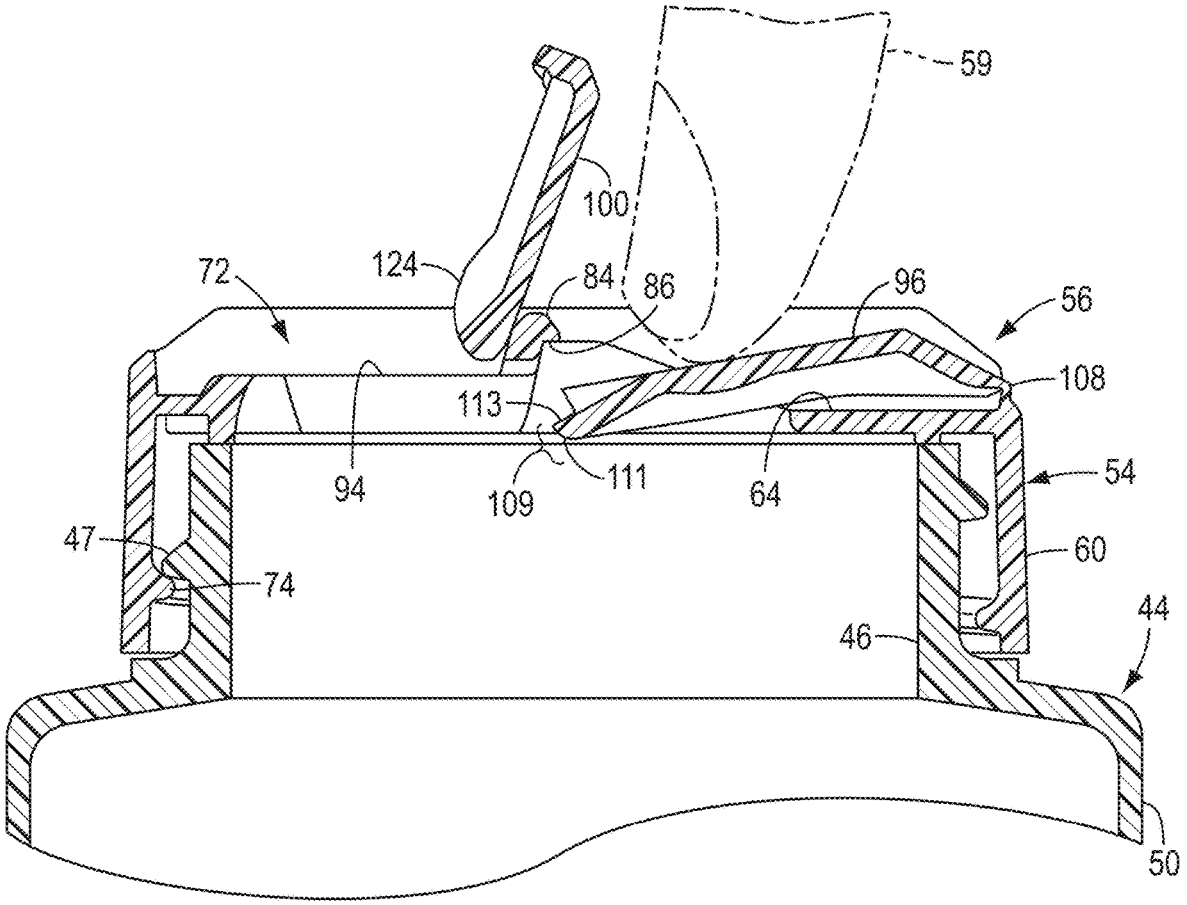
FIG. 15 is a fragmentary, cross-sectional view of the closure and container illustrated in FIG. 1, taken generally along the plane 14-14 in FIG. 7, but FIG. 15 shows the cover portion of the lid moved to an unlatched open position corresponding to FIGS. 3, 4, and 11.

With reference to FIGS. 15 and 17, the cover portion 100 of the lid 56 is provided with a pair of side camming surfaces or cam surfaces 124 extending therefrom for engaging the cam followers 94 on the recessed front deck 65 of the closure body 54 when the cover portion 100 is in the latched closed position. Engagement of the cam surfaces 124 with the cam followers 94 assist the lid cover portion 100 from moving out of the latched closed position (as illustrated in FIGS. 1 and 8) and into the unlatched open positions (as illustrated in FIG. 10).

With reference to FIGS. 1, 2, and 5, the press portion 96, cover portion 100, and initially biased, bi-stable hinge 104 are oriented relative to the closure body 54 in an operative configuration for providing a durable latching unlatching action and for easy, one-handed operation by a user of the closure 40. As will be discussed in greater detail below, a user's thumb or finger 59 (FIGS. 10 and 11) may engage and force the press portion 96 downwardly in the direction of arrow 57 (in FIGS. 2-4) to deflect the press portion 96 relative to the closure body 54. As will be explained in detail hereinafter, initial deflection of the press portion 96 toward the closure body 54 a predetermined amount causes the cover portion 100 to initially move slightly forwardly (to the left in FIGS. 8 and 9) to unlatch the cover portion 100 from the closure body 54. Continued downward pressing on the press portion 96 causes the biased hinge 104 to move from the first self-maintained, stable configuration (FIG. 8) through the dead center point (FIG. 10), after which the cover portion 100 moves to the second self-maintained, stable position shown in FIGS. 11 and 12. Thus, the deflection of the press portion 96 by the user assists the user in opening or otherwise rotating the cover portion 100 relative to the closure body passage 72.

Figure 9:
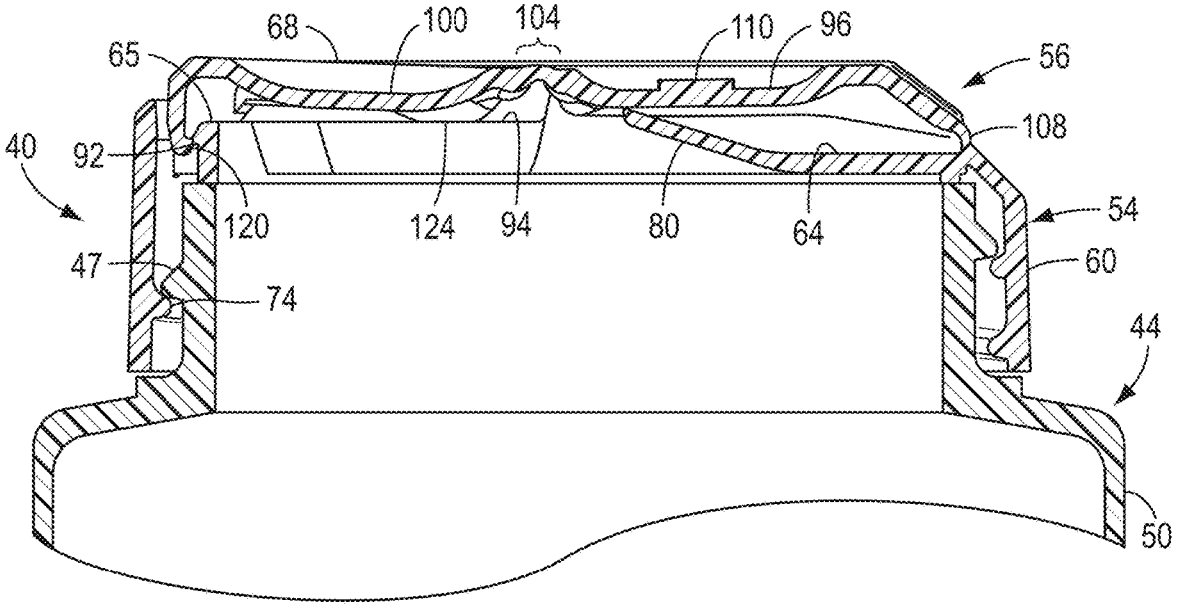
FIG. 9 is a fragmentary, cross-sectional view of the closure and container illustrated in FIG. 1, taken generally along the plane 8-8 in FIG. 7, but FIG. 9 shows the cover portion of the lid moved slightly away from the fully latched closed position in FIG. 8 toward an unlatched open position.
Figure 10:
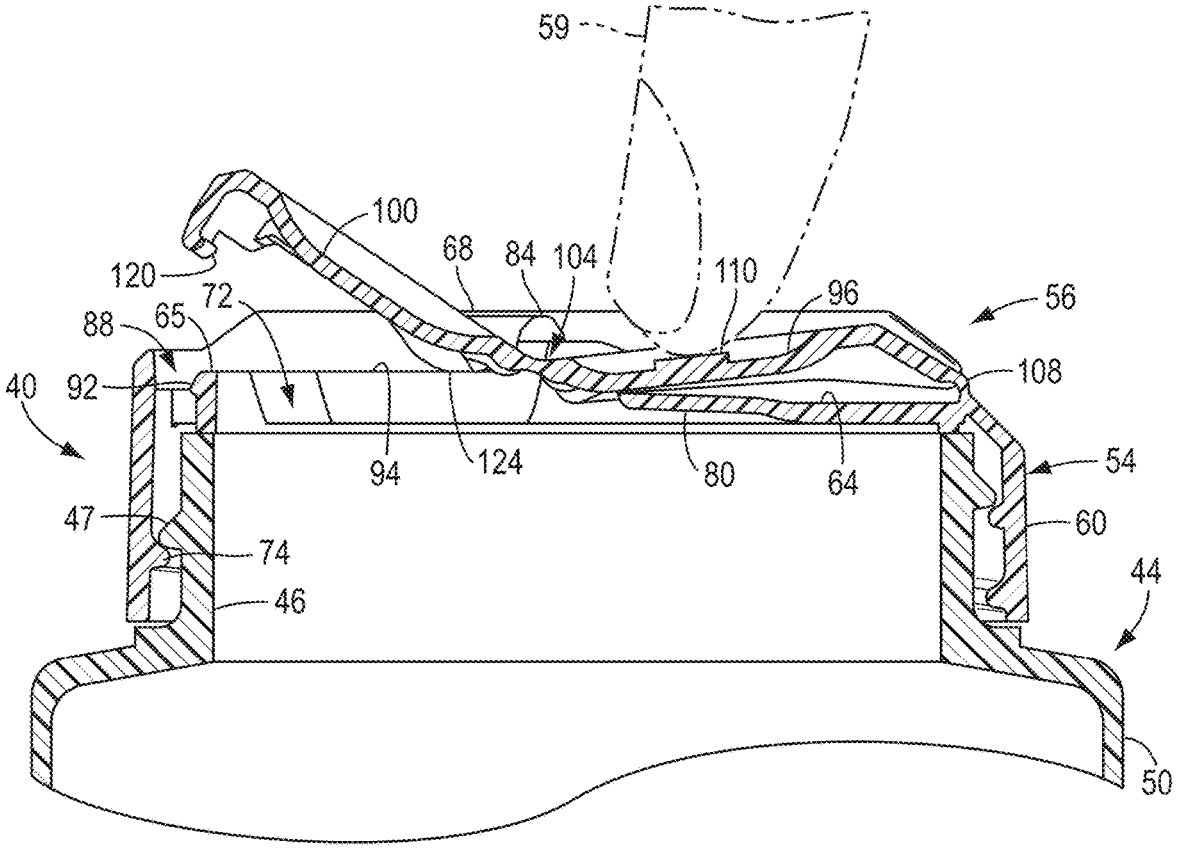
FIG. 10 is a fragmentary, cross-sectional view of the closure and container illustrated in FIG. 1, taken generally along the plane 8-8 in FIG. 7, but FIG. 10 shows the cover portion of the lid moved away from the position in FIG. 9 to an unlatched intermediate open position corresponding to FIG. 2.

As used in this specification and claims with respect to the first embodiment of the closure 40, and the other embodiments, the term "unlatched open position" means a position of the lid cover portion 100 in which at least a part of the cover portion 100 is moved sufficiently away from the latched closed position (e.g., FIGS. 1 and 8) such that the first latch portion 92 is disengaged from the second latch portion 120 (compare FIGS. 8, 9 and 10). As shown in FIGS. 10, 11, and 12, the cover portion 100 is movable into a number of open positions, any one of which is an unlatched open position, per se.

In the first illustrated embodiment of the closure 40, the lid 56 is initially molded in the inoperative configuration relative to the closure body 54 as illustrated in FIG. 19 (wherein the hinge 104 per se is in the second stable configuration corresponding to the configuration of the hinge 104 in FIG. 12). The closure manufacturer would then rotate the lid 56 about the living hinge connection 108 relative to the closure body 54 such that the side portions of the front end of the press portion 96 confront, and then slide beneath, the retainers 84 to thereby constrain the press portion 96 beneath the retainers 84. The closure manufacturer would further rotate the cover portion 100 about the hinge 104 from the one stable position of the cover portion 100 (shown in FIG. 12), through the dead center point of the hinge 104 (FIG. 10), then into the other stable position of the cover portion 100 (FIG. 8) so as to latch the first latch portion 92 with the second latch portion 120—thereby establishing a latched closed position of the cover portion 100. When the cover portion 100 latched to the closure body 54, the hinge 104 is located generally between the retainers 84 on the closure body 54. In this latched closed position, the mechanical latching of the cover portion 100 with the closure body 54 prevents, or substantially minimizes, the likelihood of the cover portion 100 from inadvertently opening as a result of impacts, forces, pressurization during shipping, and/or handling of the closure 40.

The inventor has found that this advantageous configuration of the closure body 54 and the lid 56 is especially suited for preventing inadvertent opening of the lid 56 during the shipping and handling of the closure 40 attached to a container 44 of a substance in the form of a package, such as in e-commerce, whereby the package may be packed in a number of orientations and shipped in a wide variety of parcels that may be subjected to a wide range of impulse or impact forces, vibrations, pressures, temperatures, and changes in orientation. In addition, the mechanical latching mechanism is not subject to decay that may cause failure of other closure designs that rely on a stress fit engagement between the lid and the closure body.

The detailed operation and function of the closure 40 will next be described with initial reference to FIG. 1. Typically, a user, such as a consumer, will encounter the closure 40 as shown in FIG. 1, with the closure 40 installed upon the top end of a container 44 of a substance (i.e., product)—the closure 40, container 44, and substance within the container 44 together defining a package.

The user would encounter the closure 40 installed atop a container 44 of a substance in the form of a package wherein the cover portion 100 is oriented in the latched closed position relative to the closure body 54. In this latched closed position, the cover portion 100 is mechanically engaged with the closure body 54 in an orientation in which inadvertent or premature opening of the lid 56 relative to the closure body 54 is prevented, or at least minimized, during shipping or handling of the package, or when the package is subjected to higher pressures developed within the package as a result of temperature increases or impacts.

With reference to FIG. 8, the press portion 96 of the lid 56 is biased against the retainers 84 (visible in FIG. 14) by the spring member 80 of the closure body 54. The user can begin to move the lid cover portion 100 out of the latched closed position by pressing down on the top surface of the press portion 96 to deflect and rotate the press portion 96 relative to the closure body 54 about the film hinge connection 108. Initially, until the user exerts a sufficiently high force, the spring member 80 (together with engagement of the cam surfaces 124 with the cam followers 94) prevents the front end of the press portion 96 from deflecting downwardly a significant amount. The pressing force causes the press portion 96 to rotate about the hinge connection 108, causing the hinge 104 to slightly elongate, at least initially, to thereby move the cover portion 100 very slightly forward so as to begin to disengage the latch portions 92 and 120 as shown in FIG. 9.

With continued reference to FIG. 9, as the user exerts more force on the press portion 96, the force deflects the press portion 96 downwardly to cause (i) the spring member 80 to deflect downwardly toward the interior of the container 44, and (ii) the cover portion cam surfaces 124 to also slide and/or roll (pivot) atop the cam followers 94 to move the lid latch portion 120 upwardly relative to the closure body latch portion 92. The resiliency of the material of the latch portions 92 and/or 120 accommodates the deflection necessary to overcome the mechanical engagement thereof as the cover portion 100 pivots upwardly toward the dead center point of the hinge 104 as illustrated in FIG. 10.

With continued reference to FIG. 10 showing the latch portions 92 and 120 disengaged, the user continues to deflect the press portion 96 against the spring member 80 as the cam surfaces 124 continue to slide and/or roll (pivot) atop the cam followers 94 until the hinge 104 crosses the dead center point (illustrated in FIG. 10). When the hinge 104 crosses the dead center point, the cover portion 100 snaps into the self-maintained, second stable position as shown in FIG. 11.

Figure 16:
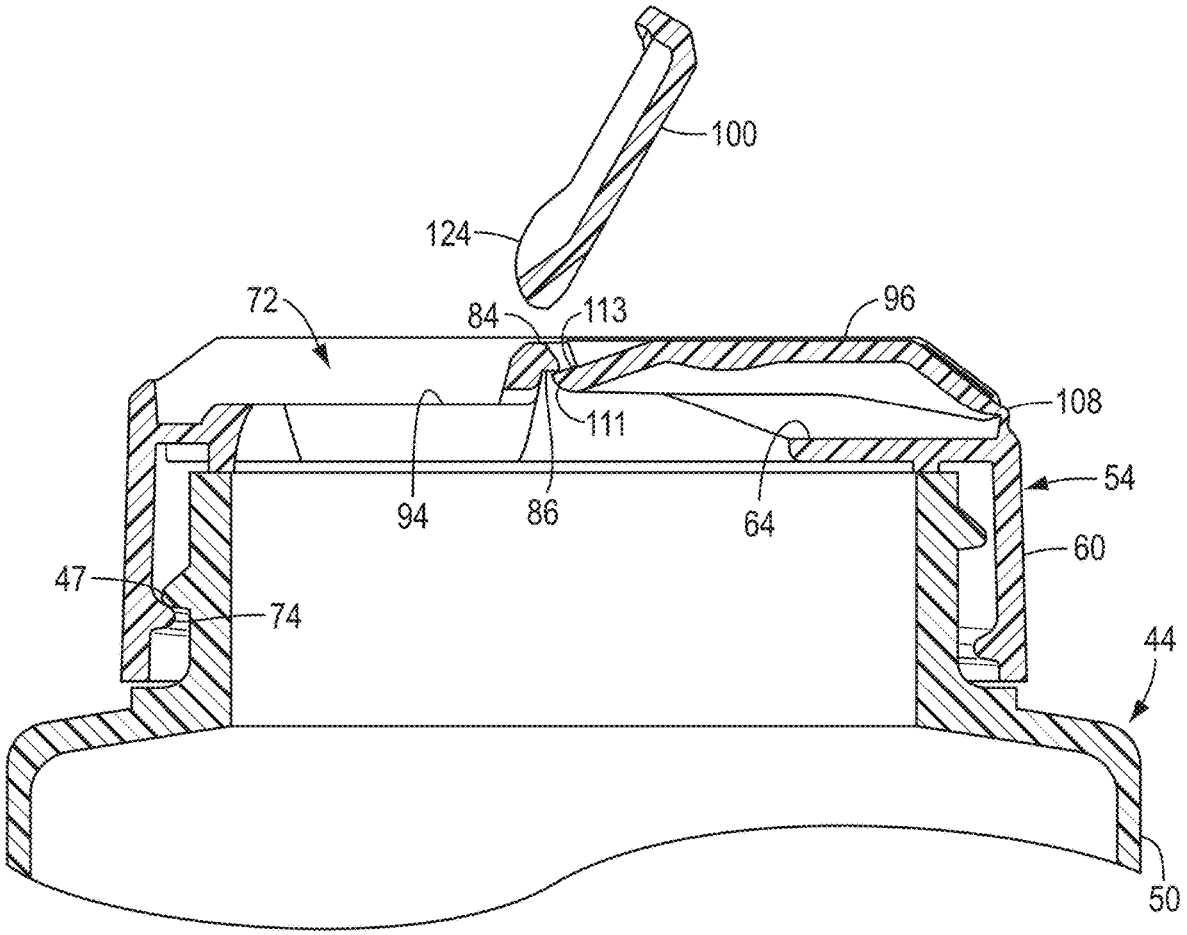
FIG. 16 is a fragmentary, cross-sectional view of the closure and container illustrated in FIG. 1, taken generally along the plane 14-14 in FIG. 7, but FIG. 16 shows the open cover portion of the lid moved to an elevated position compared to FIG. 15, and FIG. 16 corresponds to FIG. 12.

With reference to FIG. 11, if the user releases the press portion 96 at this stage of operation of the closure 40, the potential energy stored within the spring member 80 urges the press portion 96 upward (to the position shown in FIG. 12) to return the press portion 96 to its initial elevated position against the retainers 84 (as shown in FIG. 16). The cover portion 100 of the lid 56 is therefore also elevated in its self-maintained stable position to expose the passage 72 so that the substance can be removed from the container 44 through the opened closure 40. When opened, the cover portion 100 is preferably oriented greater than about 90 degrees away from the latched closed position, and is more preferably oriented about 120 degrees away from the latched closed position (when the cover portion 100 is in the unlatched open position shown in FIG. 12).

It will be understood that the user could manually push or pull on the open cover portion 100 further away from the position shown in FIG. 12 so as to further bend or rotate the cover portion 100 of the lid 56 away from the latched closed position to an even greater degree than illustrated in FIG. 12. However, if such operation is contemplated, then the manufacturer should provide a sufficiently robust design that would permit such operation without exceeding the stress or fatigue limitations of the hinge 104.

With the cover portion 100 in the unlatched open position illustrated in FIGS. 5 and 6 (corresponding to FIG. 12), the user may grasp the container 44 to invert the container 44 and remove the product substance contained therein. In some situations, the user could also use a utensil to scoop or otherwise remove the substance from within the container 44. In any event, during the removal of the product, the substance initially enters into the interior volume of the closure body 54 and exits the closure 40 from the uncovered passage 72.

After dispensing or removing the substance through the opened closure 40, the user may then shut the closure 40 by moving the cover portion 100 of the lid 56 from the unlatched open position illustrated in FIGS. 5 and 12 to its latched closed position illustrated in FIGS. 1 and 8. Specifically, the user would press against the exterior side of the distal end of the open cover portion 100 near the second latch portion 120 to rotate the cover portion 100 relative to the press portion 96 about the hinge 104. The cover portion 100 is rotated sufficiently about the pivot portion 112 to reconfigure the hinge 104 past the dead center point (FIG. 10) toward the other stable position of the cover portion 100. The user would continue to rotate the cover portion 100 by pressing against it until the second latch portion 120 is received within the arcuate aperture 88 at the front of the closure body 54, and the lid latch portion 120 cooperatively re-engages the first latch portion 92 so as to maintain the cover portion 100 in a latched closed position covering the through passage 72 (FIGS. 1 and 8).

With the cover portion 100 returned to its latched closed position, the press portion 96 is biased against the retainers 84 by the spring member 80, and the cam surfaces 124 contact the cam followers 94 so that the closure 40 is returned to the closed condition and is ready to again be opened by a user. It will be understood that in some applications, the spring member 80 need not be provided if there is a sufficiently strong bias in the hinge connection 108 between the press portion 96 and the closure body 54, which is sufficient to bias the press portion 96 against the retainers 84.

Figure 20:
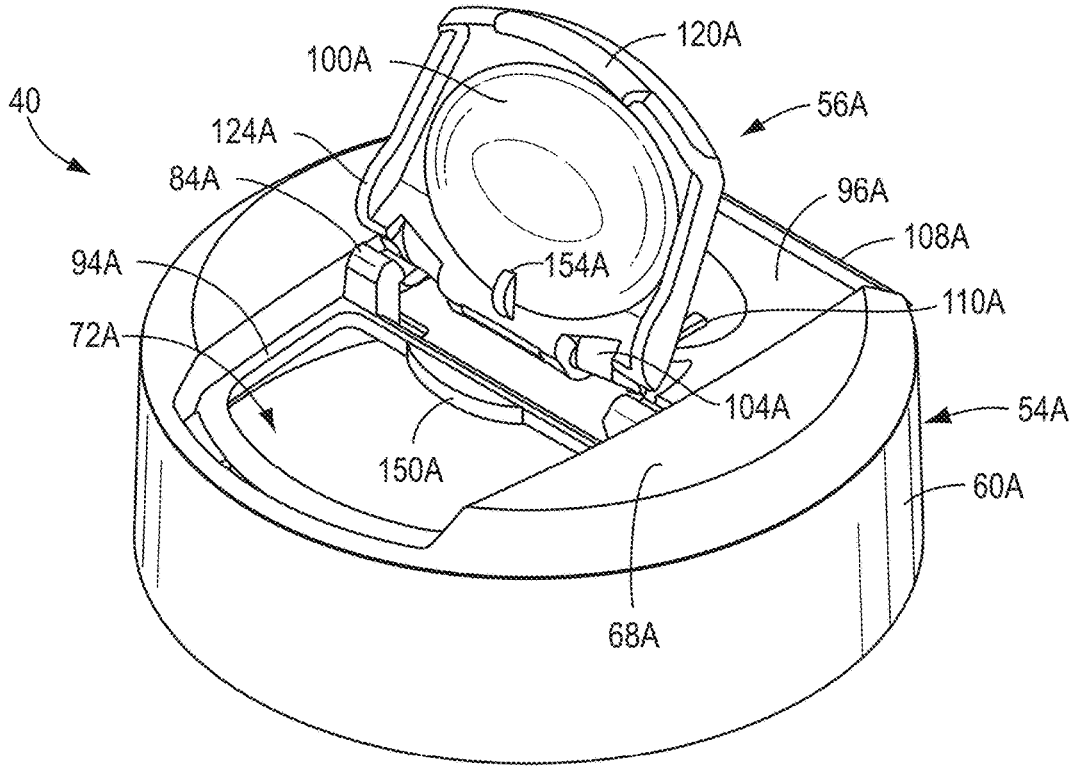
FIG. 20 is a perspective view, taken from above, of a second embodiment of a closure of the present invention shown with the cover portion of the lid in an unlatched open position.

A second embodiment of a closure according to the present invention is illustrated in FIG. 20 only and is designated generally by the numeral 40A. As will be discussed in detail below, the second illustrated embodiment of the closure 40A functions generally in the same manner as the first illustrated embodiment of the closure 40, and includes the basic functional elements of a closure body 54A and a lid 46A to control the communication between the interior and exterior of a container (not illustrated in FIG. 20) upon which the closure 40A is installed or formed. The numbered features of the second embodiment of the closure 40A illustrated in FIG. 20 are designated generally with the suffix letter "A" and are functionally analogous to features of the first embodiment of the closure 40 that share the same number (without the suffix letter "A"). The detailed discussion above of such features of the first embodiment of the closure 40 applies to the second embodiment of the closure 40A, to the extent that such preceding discussion does not contradict the following discussion.

With reference to FIG. 20, the second embodiment of the closure 40A differs from the first embodiment of the closure 40 in that the second embodiment of the closure 40A includes additional camming features to assist the cover portion 100A of the lid 56A in moving away from its latched closed position into its unlatched open positions. In particular, the closure body 54A is provided with a camming lip or cam follower 150A extending laterally toward the center of the passage 72A. In addition, the cover portion 100A of the lid 56A includes a central camming projection 154A which rotates and/or slips against the stationary camming lip 150A to urge the cover portion 100A laterally forward a small amount to unlatch the mating latch features on the cover portion 100A and the closure body 54A. The camming lip 150A and the camming projection 154A provide a more robust and rigid opening mechanism as compared to the first illustrated embodiment of the closure 40, which may be beneficial for some more flexible materials from which the lid 56A could be molded or otherwise made.

Figure 21:
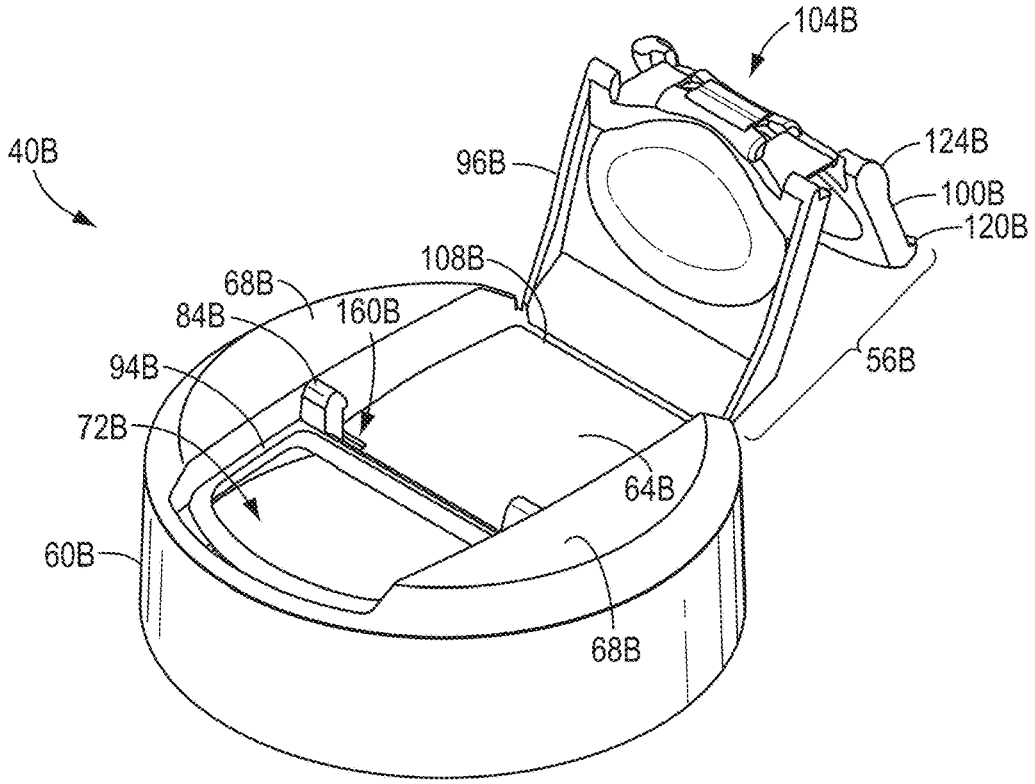
FIG. 21 is a perspective view, taken from above, of a third embodiment of a closure of the present invention in an as-molded condition.
Figure 22:
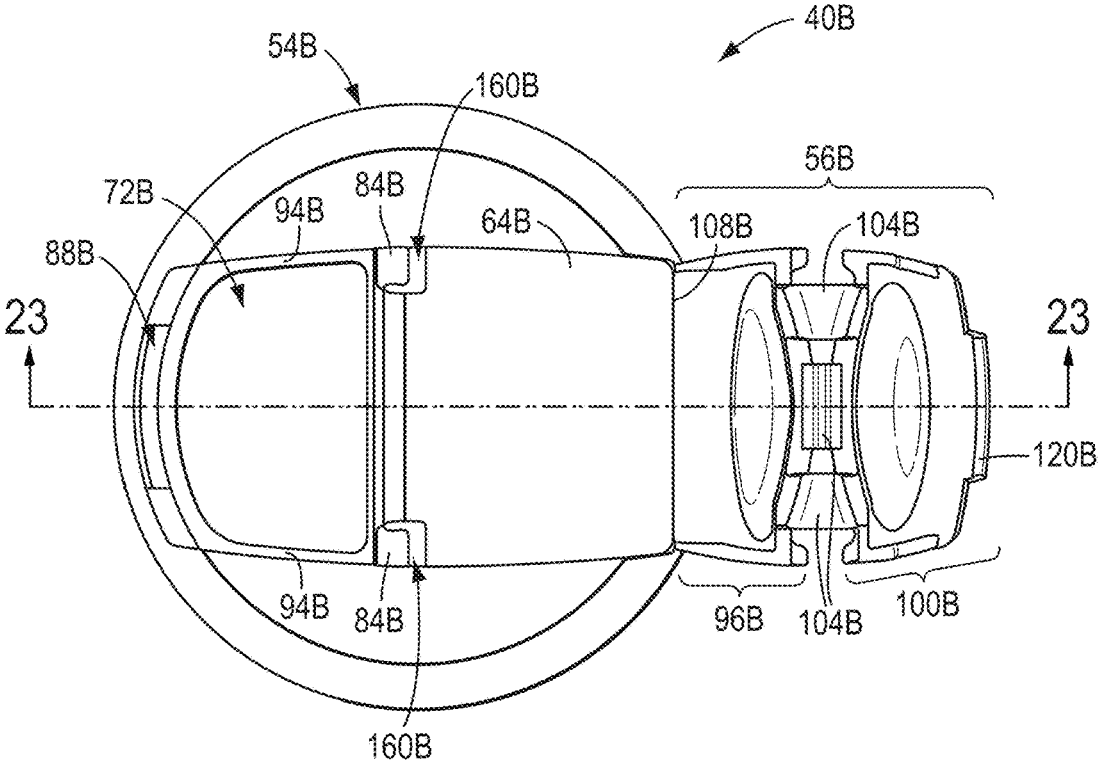
FIG. 22 is a top plan view of the third embodiment of the closure illustrated in FIG. 21.
Figure 23:
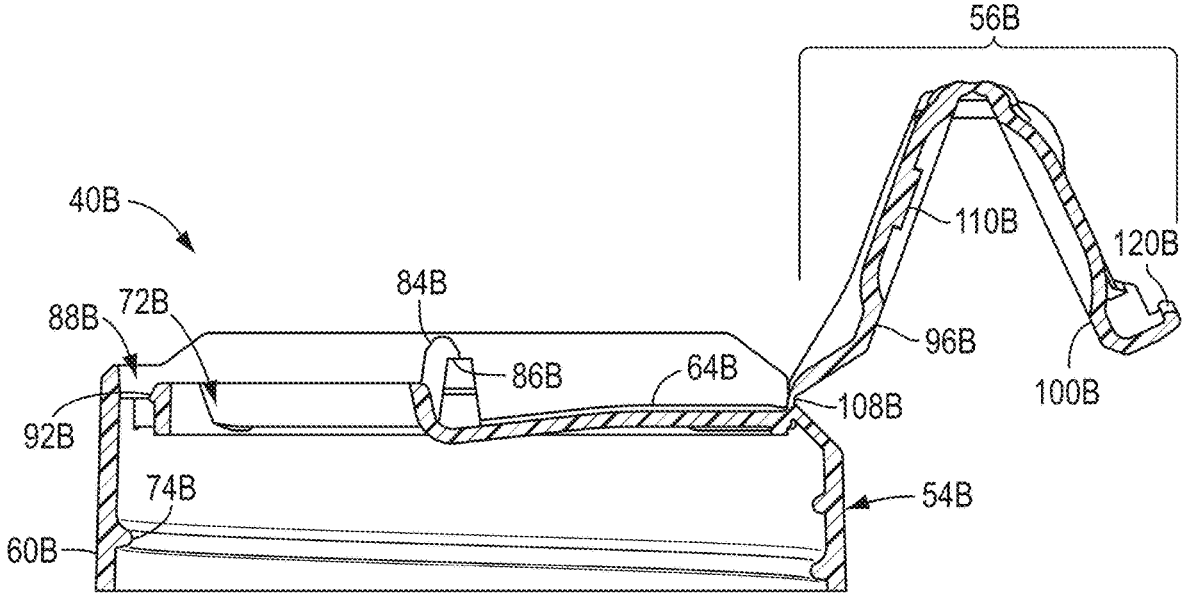
FIG. 23 is a cross-sectional view of the closure illustrated in FIG. 21, taken generally along the plane 23-23 in FIG. 22.

A third embodiment of a closure according to the present invention is illustrated in FIGS. 21-23 and is designated generally by the numeral 40B. As will be discussed in detail below, the third illustrated embodiment of the closure 40B functions generally in the same manner as the first illustrated embodiment of the closure 40, and includes the basic functional elements of a closure body 54B and a lid 46B to control the communication between the interior and exterior of a container (not illustrated in FIGS. 21-23) upon which the closure 40B is installed or formed. The numbered features of the third embodiment of the closure 40B illustrated in FIGS. 21-23 are designated generally with the suffix letter "B" and are functionally analogous to features of the first embodiment of the closure 40 that share the same number (without the suffix letter "B"). The detailed discussion above of such features of the first embodiment of the closure 40 applies to the third embodiment of the closure 40B to the extent that such preceding discussion does not contradict the following discussion.

FIGS. 21-23 illustrate the third embodiment of the closure 40B with the lid 56B in an initially molded, inoperative configuration relative to the closure body 54B. As with the first illustrated embodiment of the closure 40, the closure manufacturer would then rotate the lid 56B about the living hinge connection 108B relative to the closure body 54B such that the press portion 96B confronts, slides overtop of, and beneath, the retainers 84B to thereby constrain the press portion 96B beneath the retainers 84B. The closure manufacturer would further rotate the cover portion 100B about the hinge 104B from the one stable position, through the dead center point of the hinge 104B, to another stable position, and then latch the first latch portion 92B (visible in FIG. 23 only) with the second latch portion 120B to establish a latched closed position of the cover portion 100B. In this latched closed position, the mechanical latching of the cover portion 100B with the closure body 54B prevents, or substantially minimizes, the likelihood of the cover portion 100B from inadvertently opening as a result of impacts, forces, pressurization during shipping, and/or handling of the closure 40B.

With reference to FIGS. 21-23, the third embodiment of the closure 40B differs from the first embodiment of the closure 40 in that the second embodiment of the closure 40B has a closure body 54B with a large recessed deck 64B and no spring member (i.e., no spring member corresponding to the first embodiment spring member 80). The recessed deck 64B has a pair of apertures 160B to assist in easily molding or forming the features of the retainers 84B. In addition, the connection 108B by itself has a sufficient resiliency to bias the press portion 96B against the retainers 84B (when the lid press portion 96B in the operative configuration analogous the configuration of the first embodiment of the closure press portion 96 illustrated in FIGS. 1, 5, 6, 13, 14, and 16).

The large recessed deck 64B (without the spring member 80 used in the first embodiment of the closure 40) may be more easily manufactured and may prevent contents of a container from entering the space beneath the press portion 96B as compared to the first illustrated embodiment of the closure 40.

The apertures 160B may be eliminated altogether if side action molding components or lifters are used in the molding of the closure 40B. Elimination of the apertures 160B would further prevent or at least minimize the likelihood that the contents of the container would enter the space beneath the press portion 96B, which could interfere with its operation.

It will be noted that the cover portion 100B of the lid 56B does not seal, in a liquid tight manner, around the through passage 72B. However, the cover portion 100B could be modified and provided with an angled, internal wall or spud (not illustrated) extending downwardly therefrom, which would serve seal against the recessed deck 64B (on top of the deck 64B or inside of the through passage 72B) when the cover portion 100B is located in the latched closed position, so as to occlude the passage 72B of the closure body 54B, and prevent ingress or egress of a fluent substance or product through the closure 40B. It will be understood that any such angled, internal wall would need to accommodate the requisite forward lateral movement of the cover portion 100B during the unlatching process from the closure body 54B.

If desired, the closures 40, 40A, 40B described above could be modified to provide tamper resistant features. For example, and with reference to the first illustrated embodiment of the closure 40, some portion of the closure lid 56 or body 54 might be frangible and break upon the initial movement of the press portion 56 downward into the recessed deck 64. Alternatively, the interference between the latch portions 92 and 120 might be increased to form a more aggressive latch, while the connection 108 in the form of a living hinge might be lengthened to enable a user to disengage the strengthened latch. For example, the user would be required to press or slide the press portion 96 laterally toward the front of the closure 40 while simultaneously pressing downward in a complex dual motion in order to move the cover portion 100 of the lid 56 away from the latched closed position.

According to one broad aspect of the invention, the hinge 104 need not be a bi-stable hinge so long as the hinge is at least initially biased to a configuration of higher stress when the cover portion 100 is in the latched closed condition so that, upon deflection of the pressing portion 96 to release the latching structures, the biased hinge 104 moves the cover portion 100 to a desired open configuration.

According to yet another broad aspect of the invention, for some applications any of the closures 40, 40A, 40B described above need not be provided with any latch feature or features. Such a closure, not illustrated, would have the basic components of a body and a lid. The lid would have a press portion with a connection to the body and is deflectable relative to the body about the connection. The lid would have a cover portion with a closed position at least partially occluding a passage through the body. The lid would further be provided with a biased hinge connecting the cover portion with the press portion to accommodate movement of the cover portion between (a) a closed position, and (b) an open position moved away from the closed position. As with the other illustrated embodiments, deflection of the press portion moves the cover portion and urges the cover portion away from the closed position.

It will be appreciated that while various theories and explanations have been set forth herein with respect to how the component configurations and arrangements may affect the operation of the inventive closures, there is no intention to be bound by such theories and explanations. Further it is intended that all structures falling within the scope of the appended claims are not to be otherwise excluded from the scope of the claims merely because the operation of such closures may not be accounted for by the explanations and theories presented herein.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. A closure that can control communication between the exterior and the interior of a container having an opening between the exterior and the interior of the container where a substance may be stored, said closure comprising:

A. a closure body that
  1) can be located at the container opening and that defines a passage through said body for communicating with the container opening, and
  2) defines a first latch portion;

B. a lid that has
  1) a press portion that (a) has a connection to said closure body and (b) is deflectable,
  2) a cover portion that includes a second latch portion for releasably engaging said closure body first latch portion to releasably hold said cover portion in a latched closed position in which said cover portion at least partially occludes said passage, and
  3) a biased hinge connecting said cover portion with said press portion to accommodate movement of said cover portion between (a) said latched closed position, and (b) an unlatched open position moved away from said latched closed position when said first latch portion is disengaged from said second latch portion; and C. an arrangement of said closure body, said press portion, said cover portion, and said biased hinge that
  1) locates said cover portion to extend between said biased hinge and said body first latch portion when said cover portion is in said latched closed position, and
  2) locates said press portion to extend between said biased hinge and said connection to said closure body when said cover portion is in said latched closed position, whereby deflection of said press portion moves said cover portion to disengage said second latch portion from said first latch portion and urges said cover portion away from said latched closed position; and wherein said closure body further comprises a spring member for engagement with said press portion to bias said press portion against at least one retainer portion on said closure body.

2. A closure that can control communication between the exterior and the interior of a container having an opening between the exterior and the interior of the container where a substance may be stored, said closure comprising:

A. a closure body that
  1) can be located at the container opening and that defines a passage through said body for communicating with the container opening, and
  2) defines a first latch portion;

B. a lid that has
  1) a press portion that (a) has a connection to said closure body and (b) is deflectable,
  2) a cover portion that includes a second latch portion for releasably engaging said closure body first latch portion to releasably hold said cover portion in a latched closed position in which said cover portion at least partially occludes said passage, and
  3) a biased hinge connecting said cover portion with said press portion to accommodate movement of said cover portion between (a) said latched closed position, and (b) an unlatched open position moved away from said latched closed position when said first latch portion is disengaged from said second latch portion; and C. an arrangement of said closure body, said press portion, said cover portion, and said biased hinge that 1) locates said cover portion to extend between said biased hinge and said body first latch portion when said cover portion is in said latched closed position, and 2) locates said press portion to extend between said biased hinge and said connection to said closure body when said cover portion is in said latched closed position, whereby deflection of said press portion moves said cover portion to disengage said second latch portion from said first latch portion and urges said cover portion away from said latched closed position; and said closure body includes a camming lip extending laterally toward said passage, and said cover portion of said lid includes a central camming projection, wherein deflection of said press portion relative to said closure body causes said central camming projection to rotate against said camming lip to urge said cover portion out of said latched closed position.

3. A closure that can control communication between the exterior and the interior of a container having an opening between the exterior and the interior of the container where a substance may be stored, said closure comprising:

A. a closure body that 1) can be located at the container opening and that defines a passage through said body for communicating with the container opening, and 2) defines a first latch portion;

B. a lid that has 1) a press portion that (a) has a connection to said closure body and (b) is deflectable, 2) a cover portion that includes a second latch portion for releasably engaging said closure body first latch portion to releasably hold said cover portion in a latched closed position in which said cover portion at least partially occludes said passage, and 3) a biased hinge connecting said cover portion with said press portion to accommodate movement of said cover portion between (a) said latched closed position, and (b) an unlatched open position moved away from said latched closed position when said first latch portion is disengaged from said second latch portion; and C. an arrangement of said closure body, said press portion, said cover portion, and said biased hinge that 1) locates said cover portion to extend between said biased hinge and said body first latch portion when said cover portion is in said latched closed position, and 2) locates said press portion to extend between said biased hinge and said connection to said closure body when said cover portion is in said latched closed position, whereby deflection of said press portion moves said cover portion to disengage said second latch portion from said first latch portion and urges said cover portion away from said latched closed position; and wherein said biased hinge is a bi-stable over-center toggle type hinge that defines a center pivot portion and a pair of laterally spaced strap portions.

4. A closure that can control communication between the exterior and the interior of a container having an opening between the exterior and the interior of the container where a substance may be stored, said closure comprising:

A. a closure body that 1) can be located at the container opening and that defines a passage through said body for communicating with the container opening, and 2) defines a first latch portion;

B. a lid that has 1) a press portion that (a) has a connection to said closure body and (b) is deflectable, 2) a cover portion that includes a second latch portion for releasably engaging said closure body first latch portion to releasably hold said cover portion in a latched closed position in which said cover portion at least partially occludes said passage, and 3) a biased hinge connecting said cover portion with said press portion to accommodate movement of said cover portion between (a) said latched closed position, and (b) an unlatched open position moved away from said latched closed position when said first latch portion is disengaged from said second latch portion; and C. an arrangement of said closure body, said press portion, said cover portion, and said biased hinge that 1) locates said cover portion to extend between said biased hinge and said body first latch portion when said cover portion is in said latched closed position, and 2) locates said press portion to extend between said biased hinge and said connection to said closure body when said cover portion is in said latched closed position, whereby deflection of said press portion moves said cover portion to disengage said second latch portion from said first latch portion and urges said cover portion away from said latched closed position;

wherein said closure body defines at least one retainer portion, and said press portion confronts said at least one retainer portion when said cover portion is in said unlatched open position; and said connection between said press portion and said closure body is a living hinge for biasing said press portion against said at least one retainer portion when said cover portion is located in an unlatched open position.

5. A closure that can control communication between the exterior and the interior of a container having an opening between the exterior and the interior of the container where a substance may be stored, said closure comprising:

A. a closure body that 1) can be located at the container opening and that defines a passage through said body for communicating with the container opening, and 2) defines a first latch portion;

B. a lid that has 1) a press portion that (a) has a connection to said closure body and (b) is deflectable, 2) a cover portion that includes a second latch portion for releasably engaging said closure body first latch portion to releasably hold said cover portion in a latched closed position in which said cover portion at least partially occludes said passage, and 3) a biased hinge connecting said cover portion with said press portion to accommodate movement of said cover portion between (a) said latched closed position, and (b) an unlatched open position moved away from said latched closed position when said first latch portion is disengaged from said second latch portion; and C. an arrangement of said closure body, said press portion, said cover portion, and said biased hinge that 1) locates said cover portion to extend between said biased hinge and said body first latch portion when said cover portion is in said latched closed position, and 2) locates said press portion to extend between said biased hinge and said connection to said closure body when said cover portion is in said latched closed position, whereby deflection of said press portion moves said cover portion to disengage said second latch portion from said first latch portion and urges said cover portion away from said latched closed position;

wherein said closure body defines at least one retainer portion, and said press portion confronts said at least one retainer portion when said cover portion is in said unlatched open position; and said closure body includes an aperture beneath said at least one retainer portion.

* * * * *